United States Patent [19]

Duwell et al.

[11] 4,364,569

[45] Dec. 21, 1982

[54] SIMULATED GOLF BOARD GAME

[76] Inventors: Ronald A. Duwell, 17 Chester Dr.; Jeffery A. Sabotka, 28 Ellis St., both of Windsor Locks, Conn. 06096

[21] Appl. No.: 150,177

[22] Filed: May 15, 1980

[51] Int. Cl.[3] ..... A63F 3/00

[52] U.S. Cl. ..... 273/245

[58] Field of Search ..... 273/245, 87 R, 277

[56] References Cited

U.S. PATENT DOCUMENTS

| | | | |
|---|---|---|---|
| 1,482,330 | 1/1924 | Treboul | 273/245 |
| 1,605,739 | 11/1926 | Jennings | 273/245 |
| 1,638,365 | 8/1927 | Ryan | 273/245 |
| 1,758,581 | 5/1930 | Morch | 273/245 |
| 3,260,526 | 7/1966 | Seitz | 273/245 |
| 3,410,561 | 11/1968 | Ekstrand | 273/245 X |
| 3,612,534 | 10/1971 | Browne | 273/245 |
| 3,910,581 | 10/1975 | Nicholson | 273/245 |
| 4,094,509 | 6/1978 | Barron | 273/247 |
| 4,127,273 | 11/1978 | Bonvett | 273/245 |
| 4,176,845 | 12/1979 | Lancaster | 273/245 |

*Primary Examiner*—Vance Y. Hum
*Assistant Examiner*—Scott L. Brown
*Attorney, Agent, or Firm*—Albert W. Hilburger

[57] ABSTRACT

A parlor game closely simulating the outdoor game of golf. The game board is a scaled-down plan view of an actual golf course having tees, fairways, rough areas, trouble areas, and greens. The game provides a first series of variables according to the arbitrary choice of each player including club selection and the competence level of play. The game further provides a second series of variables determined by the roll of the dice including troubles encountered hole positions on the greens, and alternate fairway routes on certain fairways. After selecting an appropriate club from a CLUB CARD, a player places his associated game piece, according to the roll of the dice, on the fairway area, rough area, or trouble area. Appropriate indicia marks represent the yardage along the fairway in five yard increments. As play proceeds, the game piece is advanced along the fairway according to the roll of the dice and encounters troubles along the way as determined from the dice and appropriate TROUBLE POSITION CARDS. By subsequent rolls of the dice and subsequent club selections, eventually, the player is able to place his game piece on the green; at this stage of the play, a HOLE POSITION CARD indicates the location of the ball on the green. By use of a PUTTING CARD upon subsequent rolls of the dice, the player ultimately sinks the ball in the hole and completes play to that hole.

30 Claims, 18 Drawing Figures

CLUB CARD

60

90

SIDE 1

| | 1 IRON (DRIVING IRON) 190 - 215 | | 2 IRON (MID IRON) 180 - 205 | | 3 IRON (MID MASHIE) 170 - 195 | | 4 IRON (MASHIE IRON) 160 - 185 | | 5 IRON (MASHIE) 150 - 175 | | 6 IRON (SPADE MASHIE) 140 - 160 | | 7 IRON (MASHIE NIBLIC) 130 - 150 | | 8 IRON (PITCHING NIBLIC) 120 - 140 | | 9 IRON (NIBLIC) 110 - 130 | | PITCHING WEDGE 100 - 120 | | |
|---|---|---|---|---|---|---|---|---|---|---|---|---|---|---|---|---|---|---|---|---|---|
| | LEFT | RIGHT | LEFT | RIGHT | LEFT | RIGHT | LEFT | RIGHT | LEFT | RIGHT | LEFT | RIGHT | LEFT | RIGHT | LEFT | RIGHT | LEFT | RIGHT | LEFT | RIGHT | |
| 21 | 210 | 195 | 190 | 180 | 170 | 195 | 165 | 185 | 150 | 165 | 145 | 155 | 150 | 140 | 135 | 125 | 130 | 115 | 120 | 105 | 21 |
| 41 | 190 | 200 | 205 | 195 | 185 | 175 | 160 | 170 | 155 | 170 | 160 | 150 | 145 | 135 | 140 | 130 | 110 | 125 | 100 | 115 | 41 |
| 42 | 195 | 215 | 180 | 185 | 175 | 190 | 180 | 160 | 175 | 150 | 140 | 145 | 130 | 150 | 120 | 140 | 125 | 120 | 105 | 120 | 42 |
| 43 | 200 | 190 | 185 | 200 | 190 | 170 | 165 | 175 | 160 | 165 | 155 | 140 | 135 | 130 | 125 | 120 | 115 | 130 | 110 | 100 | 43 |
| 61 | 205 | 210 | 195 | 180 | 175 | 180 | 170 | 180 | 165 | 155 | 150 | 160 | 140 | 145 | 130 | 135 | 120 | 110 | 115 | 105 | 61 |
| 62 | 190 | 195 | 185 | 190 | 170 | 175 | 185 | 160 | 155 | 160 | 140 | 145 | 135 | 140 | 120 | 125 | 115 | 130 | 100 | 110 | 62 |
| 63 | 215 | 205 | 200 | 205 | 180 | 185 | 175 | 165 | 170 | 150 | 160 | 140 | 150 | 130 | 135 | 130 | 110 | 115 | 120 | 115 | 63 |
| 64 | 195 | 190 | 180 | 185 | 195 | 170 | 160 | 170 | 150 | 155 | 145 | 150 | 130 | 135 | 125 | 140 | 120 | 110 | 105 | 110 | 64 |
| 65 | 205 | 200 | 190 | 195 | 185 | 180 | 175 | 165 | 160 | 175 | 150 | 155 | 140 | 145 | 130 | 120 | 125 | 120 | 110 | 100 | 65 |
| | | | | | | | | | | | | | | | | | | | | | |
| 31 | 190 | 170 | 160 | 180 | 155 | 185 | 145 | 165 | 135 | 155 | 145 | 125 | 130 | 135 | 105 | 110 | 115 | 100 | 90 | 80 | 31 |
| 32 | 175 | 200 | 190 | 155 | 175 | 145 | 155 | 140 | 150 | 125 | 130 | 135 | 115 | 110 | 120 | 115 | 105 | 90 | 85 | 105 | 32 |
| 51 | 165 | 185 | 175 | 165 | 150 | 160 | 135 | 170 | 125 | 140 | 120 | 150 | 120 | 125 | 110 | 100 | 95 | 110 | 100 | 95 | 51 |
| 52 | 205 | 175 | 155 | 195 | 145 | 155 | 175 | 145 | 160 | 130 | 135 | 140 | 110 | 120 | 115 | 125 | 100 | 120 | 110 | 90 | 52 |
| 53 | 170 | 195 | 165 | 160 | 180 | 170 | 140 | 150 | 145 | 135 | 125 | 120 | 140 | 130 | 100 | 105 | 110 | 95 | 80 | 100 | 53 |
| 54 | 180 | 165 | 185 | 170 | 165 | 150 | 160 | 135 | 130 | 165 | 140 | 130 | 125 | 115 | 130 | 120 | 90 | 105 | 95 | 85 | 54 |
| | | | | | | | | | | | | | | | | | | | | | |
| 11 | 200 | 215 | 220 | 50 | 205 | 180 | 175 | 195 | 160 | 170 | 155 | 90 | 150 | 165 | 155 | 145 | 140 | 130 | 120 | 125 | 11 |
| 22 | 135 | 230 | 200 | 210 | 200 | 195 | 190 | 170 | 40 | 180 | 165 | 170 | 80 | 155 | 140 | 130 | 60 | 145 | 110 | 50 | 22 |
| 33 | 220 | 205 | 225 | 190 | 185 | 220 | 210 | 35 | 195 | 200 | 45 | 160 | 140 | 160 | 145 | 150 | 135 | 50 | 130 | 115 | 33 |
| 44 | 240 | 225 | 125 | 205 | 210 | 115 | 180 | 205 | 175 | 180 | 165 | 175 | 145 | 170 | 135 | 140 | 125 | 140 | 125 | 120 | 44 |
| 55 | 235 | 65 | 210 | 215 | 190 | 215 | 190 | 200 | 165 | 185 | 170 | 160 | 155 | 150 | 70 | 160 | 130 | 120 | 40 | 135 | 55 |
| 66 | 210 | 220 | 195 | 230 | 40 | 200 | 105 | 185 | 190 | 95 | 180 | 150 | 160 | 40 | 150 | 45 | 150 | 135 | 140 | 130 | 66 |

92 93 95 94 58

FIG. 7A (Con'd.)

CLUB CARD

MID CHIPPING

| | 45 - 60 | | 40 - 55 | | 35 - 50 | | 30 - 40 | | 25 - 35 | | 20 - 30 | |
|---|---|---|---|---|---|---|---|---|---|---|---|---|
| | LEFT | RIGHT | LEFT | RIGHT | LEFT | RIGHT | LEFT | RIGHT | LEFT | RIGHT | LEFT | RIGHT |
| 21 | 50 | 55 | 50 | 45 | 50 | 40 | 35 | 40 | 25 | 35 | 30 | 25 |
| 41 | 60 | 50 | 45 | 40 | 35 | 45 | 40 | 30 | 35 | 30 | 25 | 20 |
| 42 | 45 | 55 | 50 | 55 | 45 | 40 | 30 | 35 | 30 | 25 | 20 | 30 |
| 43 | 50 | 60 | 45 | 50 | 35 | 50 | 35 | 40 | 25 | 35 | 30 | 25 |
| 61 | 55 | 45 | 55 | 40 | 45 | 35 | 30 | 35 | 30 | 25 | 20 | 30 |
| 62 | 60 | 55 | 40 | 45 | 40 | 50 | 40 | 30 | 35 | 30 | 25 | 20 |
| 63 | 45 | 50 | 55 | 50 | 35 | 40 | 30 | 40 | 25 | 35 | 30 | 25 |
| 64 | 55 | 60 | 40 | 45 | 40 | 35 | 40 | 35 | 30 | 25 | 20 | 30 |
| 65 | 60 | 45 | 55 | 40 | 50 | 45 | 35 | 30 | 35 | 30 | 25 | 20 |
| | | | | | | | | | | | | |
| 31 | 30 | 45 | 25 | 40 | 35 | 30 | 20 | 25 | 30 | 25 | 20 | 15 |
| 32 | 50 | 35 | 50 | 30 | 20 | 40 | 35 | 30 | 25 | 20 | 15 | 10 |
| 51 | 45 | 55 | 40 | 45 | 40 | 25 | 20 | 35 | 15 | 30 | 25 | 20 |
| 52 | 35 | 40 | 35 | 50 | 30 | 35 | 25 | 30 | 20 | 15 | 10 | 25 |
| 53 | 55 | 30 | 45 | 25 | 45 | 20 | 30 | 20 | 15 | 20 | 25 | 10 |
| 54 | 40 | 50 | 30 | 35 | 25 | 45 | 25 | 35 | 30 | 25 | 15 | 20 |
| | | | | | | | | | | | | |
| 11 | 70 | 65 | 55 | 50 | 40 | 45 | 20 | 45 | 40 | 35 | 25 | 30 |
| 22 | 60 | 75 | 65 | 60 | 50 | 20 | 35 | 40 | 45 | 40 | 30 | 35 |
| 33 | 25 | 55 | 45 | 25 | 60 | 55 | 50 | 35 | 35 | 30 | 40 | 25 |
| 44 | 50 | 60 | 70 | 55 | 65 | 50 | 40 | 45 | 40 | 20 | 30 | 35 |
| 55 | 65 | 70 | 50 | 65 | 45 | 40 | 35 | 50 | 30 | 45 | 35 | 15 |
| 66 | 55 | 50 | 60 | 45 | 55 | 60 | 45 | 40 | 35 | 30 | 25 | 40 |

60A 101 58

FIG. 7B

101

60A

WHITE TEES (NON CHAMPIONSHIP)

LONG CHIPPING

| | 90 - 110 | | 80 - 100 | | 70 - 90 | | 60 - 80 | | 50 - 70 | |
|---|---|---|---|---|---|---|---|---|---|---|
| | LEFT | RIGHT | LEFT | RIGHT | LEFT | RIGHT | LEFT | RIGHT | LEFT | RIGHT |
| 21 | 90 | 105 | 95 | 80 | 90 | 85 | 70 | 75 | 60 | 65 |
| 41 | 100 | 95 | 90 | 85 | 80 | 75 | 65 | 60 | 70 | 50 |
| 42 | 95 | 100 | 80 | 90 | 70 | 80 | 75 | 65 | 55 | 60 |
| 43 | 105 | 90 | 85 | 100 | 75 | 90 | 80 | 70 | 65 | 55 |
| 61 | 100 | 95 | 90 | 80 | 85 | 70 | 60 | 80 | 50 | 70 |
| 62 | 110 | 105 | 85 | 90 | 80 | 75 | 70 | 60 | 55 | 65 |
| 63 | 90 | 110 | 95 | 100 | 85 | 80 | 65 | 70 | 60 | 50 |
| 64 | 95 | 100 | 80 | 85 | 70 | 90 | 75 | 80 | 70 | 60 |
| 65 | 110 | 90 | 100 | 95 | 75 | 70 | 60 | 65 | 50 | 55 |
| | | | | | | | | | | |
| 31 | 95 | 90 | 70 | 60 | 50 | 75 | 65 | 40 | 45 | 60 |
| 32 | 80 | 75 | 65 | 85 | 70 | 60 | 45 | 50 | 55 | 40 |
| 51 | 70 | 95 | 90 | 80 | 75 | 65 | 70 | 55 | 60 | 50 |
| 52 | 90 | 80 | 60 | 75 | 80 | 70 | 40 | 60 | 50 | 55 |
| 53 | 75 | 100 | 85 | 70 | 60 | 55 | 50 | 65 | 35 | 45 |
| 54 | 85 | 70 | 80 | 65 | 55 | 50 | 60 | 45 | 40 | 35 |
| | | | | | | | | | | |
| 11 | 105 | 130 | 95 | 105 | 85 | 90 | 100 | 35 | 30 | 85 |
| 22 | 115 | 45 | 105 | 100 | 95 | 110 | 75 | 80 | 70 | 65 |
| 33 | 100 | 110 | 40 | 90 | 80 | 35 | 80 | 85 | 60 | 80 |
| 44 | 110 | 115 | 120 | 50 | 105 | 85 | 90 | 80 | 75 | 70 |
| 55 | 60 | 125 | 110 | 95 | 40 | 100 | 85 | 75 | 80 | 60 |
| 66 | 120 | 105 | 100 | 115 | 90 | 95 | 30 | 70 | 65 | 75 |

Red - Rough and Troubles apply
Yellow - Roughs apply only

FIG. 7B (Con'd.)

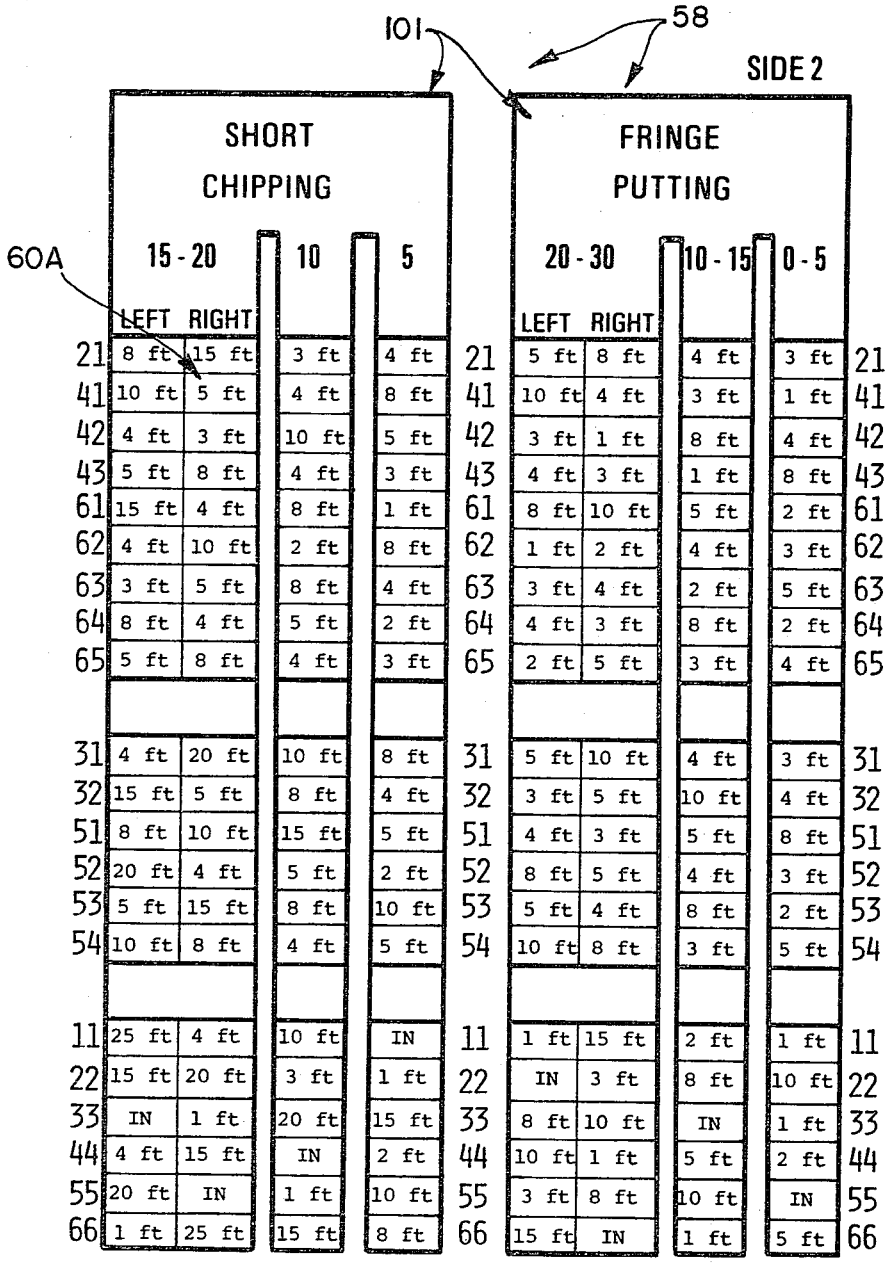
FIG. 7B (Con'd.)

TROUBLE POSITION CARD

HOLE #4

| | TROUBLE AREA | LEFT ROUGH AREA | FAIRWAY | RIGHT ROUGH AREA | TROUBLE AREA |
|---|---|---|---|---|---|
| 540 | Rough Brush | Rough Long | | Rough Long | Rough Brush |
| 535 | Rough Brush | Rough Long | | Rough Long | Rough Brush |
| 530 | Rough Brush R17-2 | Rough Long | | Rough Long | Rough Brush R17-2 |
| 525 | Rough Brush | Rough Long | | Rough Long | Rough Brush |
| 520 | Rough Brush | Rough Long | | Rough Long | Rough Brush |
| 515 | Rough Brush | Rough Long | | Rough Long | Rough Brush |
| 510 | Rough Brush R17-2 | Rough Long | | Rough Long | Rough Brush R17-2 |
| 505 | Rough Brush | Rough Long | | Rough Long | Rough Brush |
| 500 | Rough Brush | Rough Long | | Rough Long | Rough Brush |
| 495 | Rough Brush | Rough Long | | Rough Long | Rough Brush |
| 490 | Rough Brush | Rough Long | | Rough Long | Rough Brush R17-2 |
| 485 | Rough Brush R17-2 | Rough Long | | Rough Long | Rough Brush |
| 480 | Rough Brush | Rough Long | | Rough Long | Rough Brush |
| 475 | Rough Brush | Rough Long | | Rough Long | Rough Brush |
| 470 | Rough Brush | Rough Long | | Rough Long | Rough Brush |
| 465 | RghBrush LostBall R29-1 | Rough Long | | Rough Long | Rgh Long LostBall R29-1 |

| | TROUBLE AREA | LEFT ROUGH AREA | FAIRWAY | RIGHT ROUGH AREA | TROUBLE AREA |
|---|---|---|---|---|---|
| 460 | Rough Brush | Rough Long | | Rough Medium | Rough Long |
| 455 | Rough Brush R17-2 | Rough Long | | Rough Medium | Rough Long |
| 450 | Rough Brush | Rough Long | | Rough Medium | Rough Long |
| 445 | Trees | Rough Long | | Rough Medium | Rough Long |
| 440 | Rough Brush R17-2 | Rough Long | | Rough Medium | Rough Long |
| 435 | Rough Brush | Rough Long | | Rough Medium | Rough Long |
| 430 | Trees | Rough Long | | Rough Medium | Rough Brush R17-2 |
| 425 | Rough Brush | Rough Long | | Rough Medium | POND R33-3 |
| 420 | Rough Brush R17-2 | Rough Long | | Rough Medium | Rough Long |
| 415 | Trees | Rough Long | | Rough Long | POND R33-3 |
| 410 | Rough Brush | Rough Long | | Rough Long | Trees |
| 405 | Rough Brush R17-2 | Rough Long | | Rough Long | Rough Long |
| 400 | Trees | Rough Long | | Rough Medium | Trees |
| 395 | Rough Brush | Rough Long | | Rough Medium | Rough Long |
| 390 | Trees | Rough Long | | Rough Medium | Rough Long |
| 385 | Rough Brush | Rough Long | | Rough Medium | Rough Long |

Use with CLUB CARD Side 1

108 110 66 64 102 104 106 116 114 117

FIG. 9A

SIDE 1

HOLE #4

| | TROUBLE AREA | LEFT ROUGH AREA | FAIRWAY | | RIGHT ROUGH AREA | TROUBLE AREA |
|---|---|---|---|---|---|---|
| 70 | Rough Medium | Rough Medium | | | Rough Medium | Rough Medium |
| 65 | Rough Medium | Rough Medium | | | Rough Medium | Rough Medium |
| 60 | Rough Medium | Rough Medium | | | Rough Medium | Rough Medium |
| 55 | Rough Medium | Rough Medium | | | Rough Medium | Rough Medium |
| 50 | Rough Medium | Rough Medium | | | Rough Medium | Rough Medium |
| 45 | Trees | Rough Medium R16 | | | Rough Short | Rough Medium |
| 40 | Rough Medium | Rough Medium | | | Rough Short | Rough Medium |
| 35 | Rough Medium | Rough Medium | | | Rough Short | Rough Medium |
| 30 | Rough Medium | Rough Medium | | | Rough Short | Rough Medium |
| 25 | Rough Medium | Rough Medium | | | Rough Short | Rough Medium |
| 20 | Trees Left Short | Rough Medium | | | Rough Short | Rough Medium |
| 15 | Rough Medium | Rough Medium | | | Rough Short | Rough Medium |
| 10 | Rough Medium | Left Bunker | | | Rough Short | Rough Medium |
| 5 | Rough Medium | Left Bunker | | | Rough Short | Rough Medium |
| 0 | Rough Medium | Fringe | | | Fringe | Rough Medium |
| G5 | Rough Medium | Fringe | Putting Green | Putting Green | Fringe | Right Bunker |

| | TROUBLE AREA | LEFT ROUGH AREA | FAIRWAY | | RIGHT ROUGH AREA | TROUBLE AREA |
|---|---|---|---|---|---|---|
| G10 | Rough Medium | Fringe | Putting Green | Putting Green | Fringe | Right Bunker |
| G15 | Rough Medium | Fringe | Putting Green | Putting Green | Fringe | Right Bunker |
| G20 | Rough Medium | Fringe | Putting Green | Putting Green | Fringe | Rough Medium |
| G25 | Rough Medium | Fringe | Putting Green | Putting Green | Fringe | Rough Medium |
| G30 | Rough Medium | Fringe | Putting Green | Putting Green | Fringe | Rough Medium |
| -5 | Rough Medium | Rough Medium | Fringe | Fringe | Rough Medium | Rough Medium |
| -10 | Rough Medium | Rough Medium | Rough Medium | Rough Medium | Rough Medium | Rough Medium |
| -15 | Rough Medium | Rough Medium | Rough Medium | Rough Medium | Rough Medium | Rough Medium R16 |
| -20 | Rough Long | Rough Long | Rough Long | Rough Long | Rough Long | Rough Long |
| -25 | Trees Back of Green | Rough Long | Trees Back of Green | Trees Back of Green | Rough Long | Trees Back of Green |

Use with CLUB CARD Side 2

110

102

64

FIG. 9A (Con'd.)

FIG. 9A (Con'd.)

TROUBLE POSITION CARD

HOLE #4

| | TROUBLE AREA | LEFT ROUGH AREA | FAIRWAY | | RIGHT ROUGH AREA | TROUBLE AREA |
|---|---|---|---|---|---|---|
| 380 | RghBrush LostBall R29-1 | Rough Long | | | Rough Medium | Trees |
| 375 | Trees | Rough Long | | | Rough Medium | Rough Long |
| 370 | Rough Brush | Rough Long | | | Rough Medium | Rough Long |
| 365 | Rough Brush R17-2 | Rough Long | | | Rough Medium R16 | Trees |
| 360 | Trees | Trees | | | Rough Medium | Rough Long |
| 355 | Rough Brush | Trees | | | Rough Medium | Rough Long |
| 350 | Trees | Rough Medium | | | Rough Medium | Trees |
| 345 | Woods | Rough Medium | | | Rough Medium | Rough Long |
| 340 | Rough Brush R17-2 | Rough Medium | | | Rough Medium | Trees |
| 335 | Trees | Rough Medium R16 | | | Rough Medium | Rough Long |
| 330 | Woods | Rough Medium | | | Rough Medium | Rough Long |
| 325 | Trees | Rough Medium | | | Rough Medium | Trees |
| 320 | Trees | Rough Medium | | | Rough Medium | Rough Long |
| 315 | Woods | Rough Medium | | | Rough Medium | Rough Long |
| 310 | Rough Brush | Rough Medium | | | Rough Medium | Trees |
| 305 | Trees | Rough Medium | | | Rough Medium | Rough Long |

| | TROUBLE AREA | LEFT ROUGH AREA | FAIRWAY | | RIGHT ROUGH AREA | TROUBLE AREA |
|---|---|---|---|---|---|---|
| 300 | Woods | Rough Medium | | | Rough Medium | Rough Long |
| 295 | Woods | Rough Medium | | | Bunker | Rough Long |
| 290 | Trees | Rough Medium | | | Bunker | Bunker |
| 285 | Trees | Rough Medium | | | Rough Medium | Bunker |
| 280 | Woods | Rough Medium | | | Bunker | Bunker |
| 275 | Rgh Long LostBall R29-1 | Rough Medium | | | Bunker | Bunker |
| 270 | Trees | Rough Medium | | | Bunker | Bunker |
| 265 | Woods | Rough Medium | | | Rough Medium | Rough Long |
| 260 | Trees | Rough Medium | | | Rough Medium | Trees |
| 255 | Trees | Rough Medium | | | Rough Medium | Hole 5 |
| 250 | Woods | Rough Medium | | | Rough Medium | Rough Long |
| 245 | Rough Long | Rough Medium | | | Rough Medium | Trees |
| 240 | Trees | Rough Long | | | Rough Medium | Rough Long |
| 235 | Woods | Rough Long | | | Rough Medium | Rough Long |
| 230 | Rough Brush | Rough Long | | | Rough Medium | Trees |
| 225 | Trees | Rough Long | | | Rough Medium | Rough Long |

66 64 102 108 110

118 TROUBLE POSITION CARD

119

| | ROUGHS (ROUGH ADJUSTMENT) 130 BRUSH | 132 LONG | 134 MED. | 136 SHORT | AROUND THE GREEN BRUSH LONG | MED. SHORT |
|---|---|---|---|---|---|---|
| 21 | -20 | -15 | -10 | -5 | 5 ft | 8 ft |
| 41 | -30 | -10 | -15 | -10 | 15 ft | 4 ft |
| 42 | -25 | -20 | -10 | -5 | 10 ft | 15 ft |
| 43 | -20 | -15 | -5 | -10 | 4 ft | 10 ft |
| 61 | -35 | -10 | -15 | -5 | 20 ft | 3 ft |
| 62 | -30 | -15 | -5 | -10 | 8 ft | 10 ft |
| 63 | -25 | -20 | -10 | -5 | 15 ft | 8 ft |
| 64 | -35 | -10 | -5 | -10 | 10 ft | 15 ft |
| 65 | -20 | -15 | -10 | -5 | 20 ft | 5 ft |
| 31 | -10 | -20 | -15 | -10 | 15 ft | 10 ft |
| 32 | -20 | -15 | -10 | -5 | 10 ft | 25 ft |
| 51 | -15 | -20 | -15 | -10 | 25 ft | 8 ft |
| 52 | -20 | -15 | -10 | -5 | 8 ft | 15 ft |
| 53 | -15 | -20 | -15 | No Loss | 20 ft | Fringe 10 |
| 54 | -25 | -10 | -5 | -10 | Fringe 15 | 20 ft |
| 11 | No Loss | +5 | -10 | +5 | Fringe 20 | 3 ft |
| 22 | -5 | -20 | -15 | -10 | 35 ft | 25 ft |
| 33 | -15 | -10 | No Loss | -5 | 30 ft | 2 ft |
| 44 | +10 | -15 | -5 | -10 | 3 ft | 4 ft |
| 55 | -40 | -5 | -10 | -5 | 40 ft | Fringe 15 |
| 66 | -25 | No Loss | +5 | No Loss | 5 ft | 35 ft |

140 142 144 146 138 68 69

120

| | TREES LEFT | LEFT SHORT | LEFT OF GREEN | RIGHT | BACK OF GREEN |
|---|---|---|---|---|---|
| 21 | 75 | 20 ft | 5 ft | 70 | 8 ft |
| 41 | 80 | 8 ft | 10 ft | 95 | 25 ft |
| 42 | 55 | 10 ft | 20 ft | 80 | 3 ft |
| 43 | 70 | 25 ft | 4 ft | 75 | 10 ft |
| 61 | 65 | 15 ft | 8 ft | 90 | 8 ft |
| 62 | 60 | 5 ft | 3 ft | 65 | 4 ft |
| 63 | 70 | 30 ft | 5 ft | 70 | 15 ft |
| 64 | 50 | 15 ft | 8 ft | 85 | 5 ft |
| 65 | 60 | 8 ft | 15 ft | 75 | 20 ft |
| 31 | 45 | ↓ Fwy -30 | 35 ft | ↓ Fwy -20 | 40 ft |
| 32 | ↓ Fwy -40 | 25 ft | ↓ Fwy 5 mk | 55 | ↓ Rough Right G 10mk |
| 51 | 25 | Left Bunker | 40 ft | Fwy No Gain | 35 ft |
| 52 | 30 | 40 ft | Left Bunker | 40 | Right Bunker |
| 53 | 35 | Fwy 20 mk | 25 ft | ↓ Fwy -30 | 45 ft |
| 54 | Fwy No Gain | 35 ft | 30 ft | 60 | 30 ft |
| 11 | 85 | ↓ Fwy -40 | 45 ft | 100 | 60 ft |
| 22 | ↓ Fwy -20 | 50 ft | Left Bunker | 85 | ↓ Rough Back -15mk |
| 33 | 95 | Right Bunker | 2 ft | ↓ Fwy -25 | IN |
| 44 | ↓ Deeper -15 | 4 ft | ↓ Fwy 15 mk | 105 | 50 ft |
| 55 | 90 | Fringe 20 | 55 ft | Fwy No Gain | 2 ft |
| 66 | 80 | 60 ft | Lost Ball R29.1 | 30 | Left Bunker |

70 64

FIG. 9B 122 124 126 128

| | WOODS LEFT | WOODS LEFT SHORT | BUNKERS 265 TO 290 | BUNKERS (Sand Wedge) LEFT | BUNKERS (Sand Wedge) RIGHT | ROCK 180 YARDS FROM GREEN | SIDE 2 HOLE #5 RIGHT OF GREEN | |
|---|---|---|---|---|---|---|---|---|
| 21 | 50 | 30 ft | 160 | 10 ft | 8 ft | | 15 ft | 21 |
| 41 | 35 | 8 ft | 150 | 8 ft | 20 ft | | 4 ft | 41 |
| 42 | 60 | 25 ft | 145 | 5 ft | 4 ft | | 8 ft | 42 |
| 43 | 40 | 10 ft | 155 | 20 ft | 10 ft | | 20 ft | 43 |
| 61 | 35 | 5 ft | 130 | 3 ft | 5 ft | | 5 ft | 61 |
| 62 | 55 | 20 ft | 140 | 8 ft | 15 ft | | 15 ft | 62 |
| 63 | 40 | 15 ft | 120 | 15 ft | 2 ft | | 8 ft | 63 |
| 64 | 50 | 25 ft | 135 | 4 ft | 8 ft | | 10 ft | 64 |
| 65 | 45 | 20 ft | 125 | 25 ft | 10 ft | | 25 ft | 65 |
| | | | | | | | | |
| 31 | ↓ Deeper +10 | 35 ft | 100 | 20 ft | 25 ft | Woods Left 120 mk | 35 ft | 31 |
| 32 | 30 | Fwy 25 mk | 115 | 15 ft | 10 ft | Hole#5 80 mk | Left Bunker | 32 |
| 51 | Fwy No Gain | 45 ft | 135 | 30 ft | Fringe 10 | Rough Right 120 mk | 30 ft | 51 |
| 52 | 35 | Left Bunker | "DUB" Shoot Again | 25 ft | 15 ft | Fwy 80 mk | Fringe 15 | 52 |
| 53 | 15 | 40 ft | 105 | Fringe 5 | 30 ft | Fwy 130 mk | 40 ft | 53 |
| 54 | 25 | ↓ Fwy -20 | 150 | 35 ft | 20 ft | Lost Ball R29.1 | 20 ft | 54 |
| | | | | | | | | |
| 11 | Lost Ball R29.1 | Fwy No Gain | 180 | 1 ft | "DUB" Shoot Again | Rough Right 110 mk | 45 ft | 11 |
| 22 | ↓ Fwy -20 | 50 ft | 175 | 45 ft | 3 ft | Fwy 60 mk | 1 ft | 22 |
| 33 | 65 | ↓ Fwy -30 | "DUB" Shoot Again | 2 ft | 40 ft | Hole #5 65 mk | Fringe 10 | 33 |
| 44 | Lost Ball R29.1 | 4 ft | 150 | "DUB" Shoot Again | IN | Fwy 55 mk | 55 ft | 44 |
| 55 | 70 | ↓ Deeper +5 | 60 | IN | 50 ft | Hole #5 140 mk | Right Bunker | 55 |
| 66 | ↓ Deeper -25 | Lost Ball R29.1 | 170 | 55 ft | 1 ft | Lost Ball R29.1 | 60 ft | 66 |
| | | | Up | Up | Down | | | |

64 70

FIG. 9B(Con'd.)

FIG. 12 (Con'd.)

| | 90 | 85 | 80 | 75 | 70 | 65 | 60 | 55 | 50 | 45 | 40 | 35 | 30 | 25 | 20 | 15 | 10 | 8 | 5 | 4 | 3 | 2 | 1 | M | |
|---|---|---|---|---|---|---|---|---|---|---|---|---|---|---|---|---|---|---|---|---|---|---|---|---|---|
| 3 | IN | 1 | IN | 1 | IN | IN | IN | IN | IN | IN | IN | IN | IN | IN | IN | IN | M | IN | IN | IN | 1 | IN | M | IN | 3 |
| 4 | 5 | 25 | 4 | 2 | 15 | 4 | 20 | 3 | 15 | 1 | 3 | 10 | 1 | 2 | 3 | 1 | IN | 2 | IN | 1 | IN | IN | IN | IN | 4 |
| 5 | 20 | 15 | 20 | 10 | 20 | 15 | 10 | 15 | 8 | 10 | 8 | 5 | 4 | IN | IN | IN | 4 | IN | 1 | M | IN | IN | IN | IN | 5 |
| 6 | 15 | 20 | 15 | 20 | 15 | 10 | 15 | 8 | 10 | 8 | 5 | 4 | 5 | 4 | 5 | IN | IN | IN | IN | IN | M | IN | IN | IN | 6 |
| 7 | 20 | 15 | 10 | 15 | 10 | 15 | 8 | 10 | 8 | 5 | 4 | 8 | 4 | 5 | 2 | 3 | 2 | IN | IN | M | IN | M | IN | IN | 7 |
| 8 | 8 | 10 | 15 | 8 | 15 | 5 | 10 | 8 | 10 | 8 | 5 | 2 | 5 | 3 | 1 | 2 | IN | 1 | M | IN | IN | IN | IN | IN | 8 |
| 9 | 15 | 8 | 8 | 15 | 8 | 10 | 5 | 10 | 8 | 5 | 4 | 5 | 2 | 4 | 2 | 1 | 2 | IN | IN | IN | IN | IN | IN | IN | 9 |
| 10 | 10 | 15 | 10 | 8 | 10 | 8 | 10 | 8 | 5 | 8 | 5 | 4 | 3 | 2 | 4 | 2 | 1 | 2 | IN | IN | IN | IN | IN | IN | 10 |
| 11 | 15 | 10 | 8 | 10 | 8 | 10 | 8 | 5 | 8 | 5 | 8 | 5 | 4 | 3 | IN | IN | IN | IN | IN | IN | IN | IN | IN | IN | 11 |
| 12 | 10 | 15 | 10 | 8 | 10 | 8 | 5 | 10 | 5 | 8 | 5 | 4 | 3 | 2 | 3 | 1 | IN | 1 | IN | IN | IN | IN | IN | IN | 12 |
| 13 | 15 | 8 | 15 | 10 | 8 | 10 | 8 | 5 | 8 | 5 | 4 | 3 | 2 | 4 | 1 | 3 | 2 | IN | IN | IN | IN | IN | IN | IN | 13 |
| 14 | 20 | 15 | 10 | 15 | 10 | 15 | 10 | 8 | 10 | 8 | 5 | 8 | 4 | 5 | 4 | IN | IN | IN | IN | IN | IN | IN | IN | IN | 14 |
| 15 | 15 | 20 | 15 | 20 | 15 | 10 | 15 | 15 | 8 | 10 | 8 | 4 | 5 | IN | 5 | IN | 2 | IN | 1 | IN | M | IN | IN | IN | 15 |
| 16 | 20 | 15 | 20 | 10 | 20 | 15 | 8 | 10 | 15 | 5 | 4 | 5 | IN | 4 | IN | 3 | IN | IN | M | 1 | IN | IN | IN | IN | 16 |
| 17 | 25 | 5 | 15 | 20 | 3 | 20 | 5 | 15 | 2 | 15 | 10 | 4 | 8 | 5 | 1 | IN | 1 | M | 2 | IN | M | IN | M | IN | 17 |
| 18 | 1 | IN | 1 | IN | 1 | IN | IN | IN | IN | IN | IN | IN | 1 | IN | IN | M | IN | IN | IN | IN | IN | 1 | IN | M | 18 |

SIMULATED GOLF BOARD GAME

BACKGROUND OF THE INVENTION

1. Field of the Invention

This invention relates to a parlor golf game for participation by one or more players. The game provides for elements of chance but is also highly realistic of an actual outdoor game of golf.

2. Description of the Prior Art

There have been many attempts in the past to capture the concept of the outdoor game of golf in a parlor game. These have covered a wide range of concepts in order to achieve some degree of realism. Those prior art golf games known to the applicant which are representative of those games which have previously achieved some degree of realism are disclosed, for example, by the U.S. Pat. No. 1,520,081 to Purnell; Zapolski, U.S. Pat No. 3,130,973; Carroll et al, U.S. Pat. No. 3,355,175; Seitz, U.S. Pat. No. 3,260,526; Browne, U.S. Pat. No. 3,612,534; Boileau, U.S. Pat. No. 3,658,339; Strandgard, U.S. Pat. No. 4,042,246; and Conrad, U.S. Pat. No. 4,134,590. Although each of these patents may have represented improvements in the state of the art at the time that they were issued, and may have intrinsic value, they are not deemed to be anticipatory of the present invention.

In some instances, those patents recited above disclosed individual game boards representative of an entire golf course; in other instances they presented a board for an individual hole comprising tee, fairway, and green; and in some instances the representations of the course were limited to the confines of a carrying case. There were disclosures of a variety of random chance generating means including spinners, dice of various shapes, colors and indicia, spinner tops, and rotatable drums. Sometimes the information provided upon manipulation of the chance generating means required the use of scale devices for measuring distance and, possibly, directions, of the player's piece on the game board. The drawback of each of the recited patents and of all of the prior art known to the applicant resides in the limited numbers of possibilities in the play of the parlor game with a resulting lack of realism in relation to the outdoor game of golf. Indeed, some of the known games were of such a simplified format as to severely limit realism and others, in an attempt to achieve realism, were extremely complex to play, resulting in either boredom or disinterest on the part of a player.

SUMMARY OF THE INVENTION

It was with recognition of the limitations of the prior art that the present invention was conceived. To this end, the present invention discloses a parlor game closely simulating the outdoor game of golf. The game is unique in its very detailed representation of play on an actual golf course. Game equipment to accommodate one to four players includes one game board, four dice (two white, one blue, one red), one scrambler, game pieces in the form of four golfers and four associated fairway markers, three CLUB CARDS, 18 TROUBLE POSITION CARDS, six HOLE POSITION CARDS, one enlarged putting green separate from the game board, one PUTTING CARD, one official rule book, and score sheets. The game board is a scaled-down plan view of an actual golf course having tees, fairways, rough areas, trouble areas, and greens. The game provides a first series of variables according to the arbitrary choice of each player including club selection and the competence level of play: white tees representing non-championship play, red tees representing ladies' championship play, and blue tees representing men's championship play. The game further provides a second series of variables determined by the roll of the dice including troubles encountered (e.g. trees, woods, roughs, bunkers, rocks, etc.), hole positions on the greens, and alternate fairway routes on certain fairways.

A preferred age range for players would be 10 years to adult, but it is noteworthy that a player does not require a complete knowledge of outdoor golf to play the game of the present invention. After selecting an appropriate club from the CLUB CARD, a player places his associated game piece according to the roll of the dice on the fairway area, rough area, or trouble area. Appropriate indicia marks represent the yardage along the fairway in five yard increments. As play proceeds, the game piece is advanced along the fairway according to the roll of the dice and, possibly, the player encounters troubles along the way as determined from the dice and from the appropriate TROUBLE POSITION CARDS. By subsequent rolls of the dice and subsequent club selections, eventually, the player is able to place his game piece on the green. By use of the PUTTING CARD upon subsequent rolls of the dice, the player ultimately sinks the ball in the hole and completes play to that hole.

By using six-sided dice, three dice in certain instances and four dice in certain other instances, in conjunction with information provided on each of the cards, namely, CLUB CARD, TROUBLE POSITION CARD, HOLE POSITION CARD, and PUTTING CARD, there is an extremely high number of variables. At the same time, the information provided on the various cards has been chosen so as to be well within the range of possibilities of a player in keeping with the competence level of play chosen by that player. Specifically, a feature of the invention involves the correlation of the yardage obtained upon a throw of the dice with the yardage distance normally expected from a particular club under ordinary playing conditions. Another feature of the invention is the format of play which duplicates difficulties regularly encountered on the golf course and which requires golfer judgment and club selection dependent upon the lie of the ball and the conditions of a particular hole.

A further feature of the invention resides in the application of the TROUBLE CARD which provides a variety of different recovery possibilities when a player's ball lands in a trouble condition, the TROUBLE CARD providing typical results of an attempt by the player to recover from the trouble upon a subsequent roll of the dice.

Still another feature of the invention is the provision of an enlarged golf green which is used in conjunction with the PUTTING CARD to simulate the play on the green, again in accordance with average experience typical of actual play on a golf course.

Therefore, with use of the dice, CLUB CARD, TROUBLE POSITION CARD, HOLE POSITION CARD, and, eventually, the PUTTING CARD, the play of the game moves rapidly yet adheres closely to the actual outdoor game and, simultaneously, provides a wide number of possibilities rivaling those situations which could be anticipated in normal play on a regular golf course. Indeed, the combination of all of the features just described results in a reasonably simple, yet playable, game in which golfers and non-golfers alike, of a broad range of ages, can participate with equal interest and enthusiasm.

Other and further features, objects, advantages, and benefits of the invention will become apparent from the following description taken in conjunction with the following drawings. It is to be understood that the foregoing general description and the following detailed description are exemplary and explanatory but are not restrictive of the invention. The accompanying drawings, which are incorporated in and constitute a part of this invention, illustrate one embodiment of the invention, and together with the description, serve to explain the principles of the invention.

DETAILED DESCRIPTION OF THE DRAWINGS

In the Drawings:

FIG. 7B is an example of another part of a first source of information utilized in the game, namely, the CLUB CARD, side two;

FIG. 9A is an example of a part of a second source of information utilized in the game, namely, the TROUBLE POSITION CARD, side one;

FIG. 9B is an example of another part of a second source of information utilized in the game, namely, the TROUBLE POSITION CARD, side two;

DESCRIPTION OF THE PREFERRED EMBODIMENT

Figure 1A:
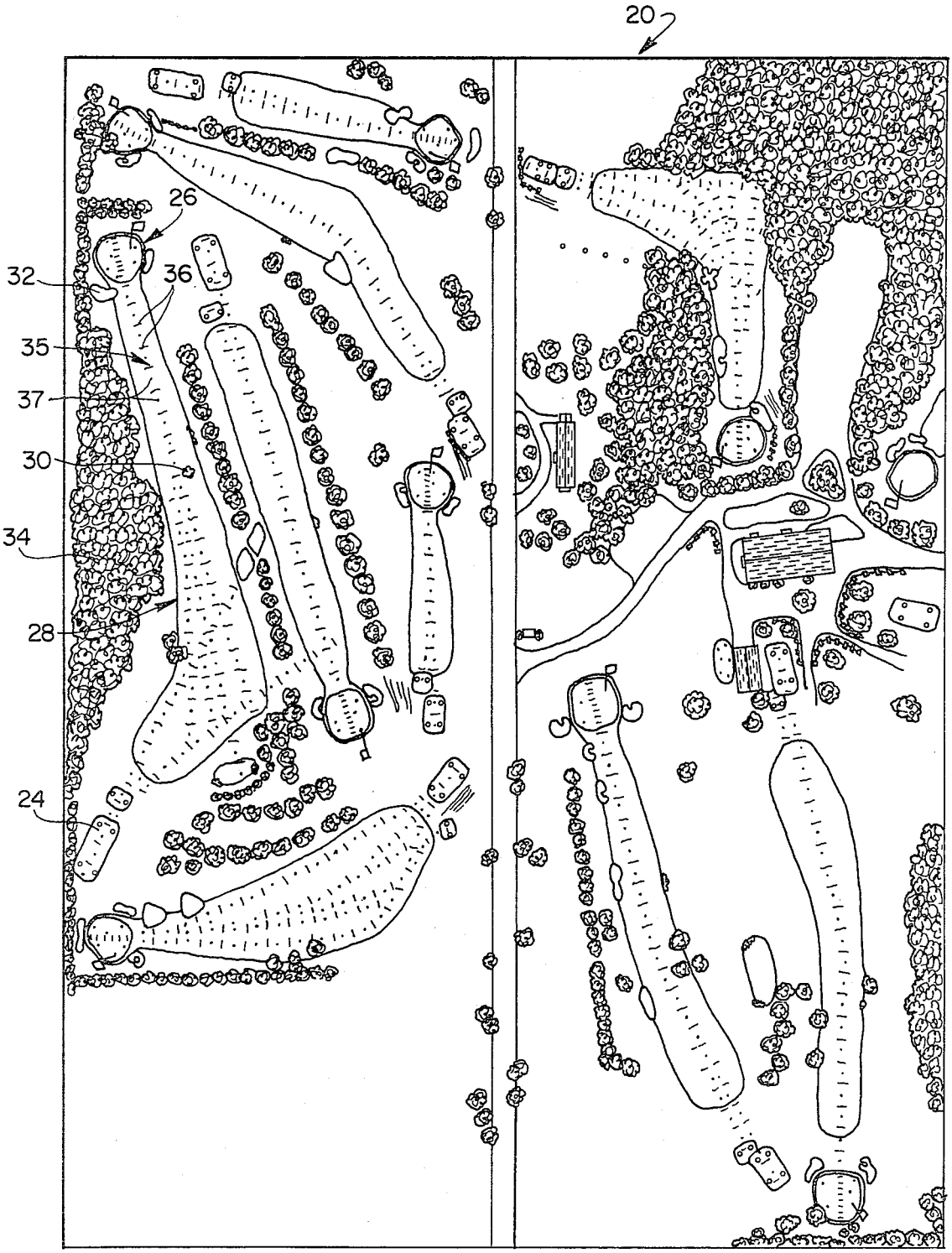
FIG. 1A is a top plan view of an appropriately marked game board representing the first nine holes of a golf course.
Figure 1B:
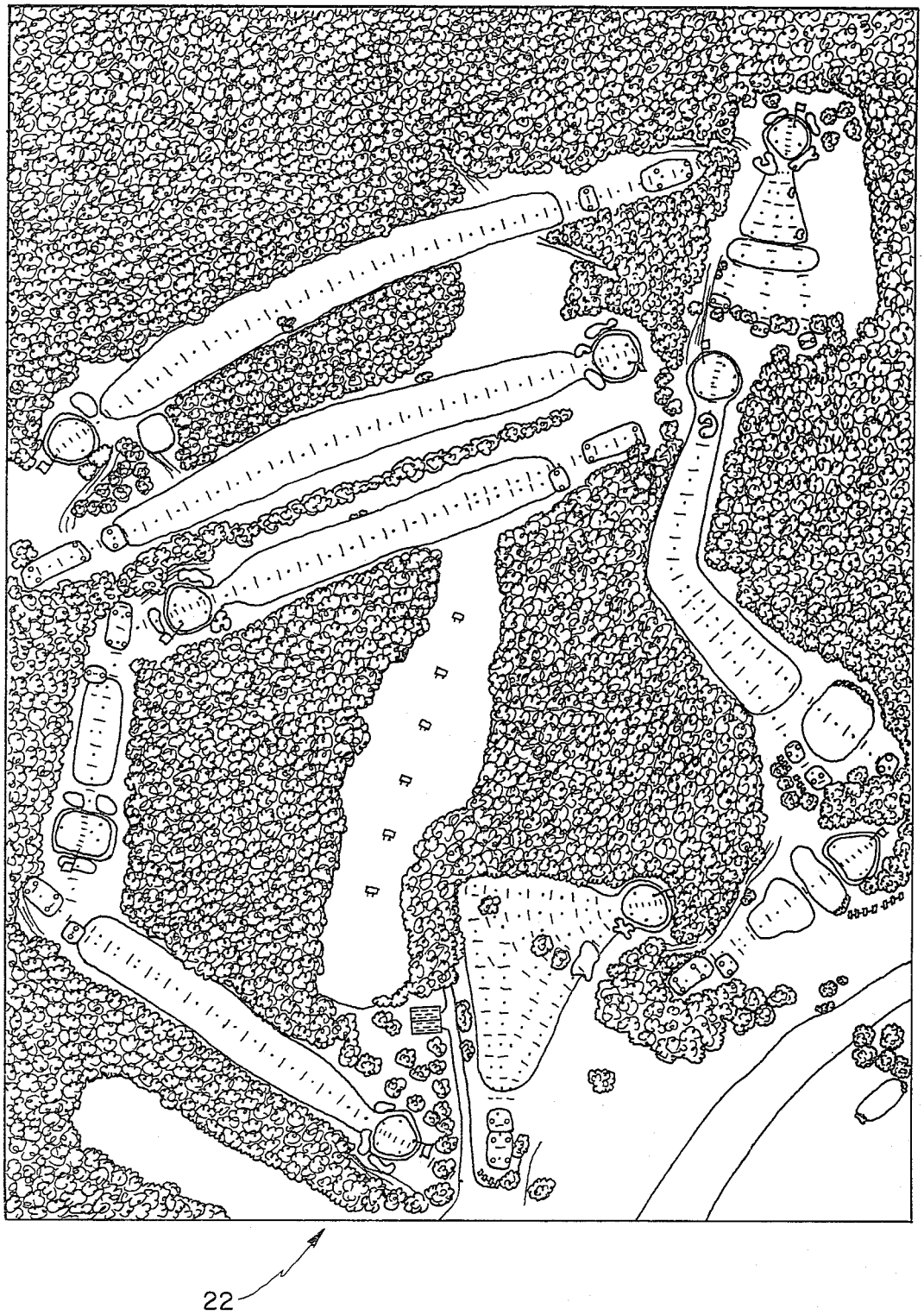
FIG. 1B is a top plan view, similar to FIG. 1A, of an appropriately marked game board representing the second nine holes of a golf course.

Refer now to the drawings and, initially, to FIG. 1A which represents, in plan view, a miniature representation of the first, or "front", nine holes of a full-scale golf course and to FIG. 1B which, similarly, illustrates the second, or "back", nine holes of a full scale golf course. The parlor game to be disclosed is a re-creation of the outdoor game of golf for play indoors and provides for a very large number of realistic possibilities, such as would be likely to be faced by a player in the outdoor game. As in the outdoor game, the object of the parlor game is to complete play to all 18 holes in the least number of strokes. The game is designed for one, two, three, or four players. Although a player does not need a total knowledge of golf to play the game, the nature of the game is such as to enable a real golfer to improve his real game by instructing him with respect to club selection, and in other ways. The game is based on an authentic eighteen hole golf course with actual troubles as they appear on the course. The course includes tees which may be appropriately colored for three levels of competence, namely, blue tees for championship men, red tees for championship women, and white tees for non-championship play. The holes themselves vary in difficulty being, variously, par three, par four, and par five holes. Additionally, the game is adapted for all types of tournament play.

In accordance with the invention, the game comprises a game board presented as a miniature, in plan view, of a full-scale golf course including appropriate pictorial representations of a tee; a green distant from said tee; a fairway generally extending between said tee and said green; a plurality of troubles positioned on said fairway, adjacent to said fairway, and distant from said fairway; and distance indicia at preselected intervals along said fairway to denote distance from said green; at least one ball marker, representing a player's ball, adapted to be moved manually and positioned on said game board; first chance means for manipulation by a player for randomly generating numbers; a first source of information including separate sets of number indicia thereon relating to each of a plurality of clubs arbitrarily chosen by a player prior to manipulation of said chance means, said number indicia of each of said sets signifying travel of the player's ball when using a particular club according to the numbers generated in response to manipulation of said first chance means; second chance means for manipulation by a player simultaneously with said first chance means for randomly indicating, from time to time, whether the player's ball following manipulation of said first and second chance means but before the ball lands on said green, is subject to a trouble situation; and a second source of information including trouble condition indicia to which the player's ball may be subjected at preselected intervals corresponding to said distance indicia and corresponding to said pictorial representations on said game board and responsive to an indication by said second chance means that said ball marker of the player is in a trouble condition signifying the extent of the trouble condition to which the player's ball is subjected upon manipulation of said first and second chance means.

As embodied herein, with initial reference to FIGS. 1A and 1B, the game board is illustrated in two parts, a first board 20 (FIG. 1A) representing, in miniature, the first, or "front" nine holes of a full-scale golf course and a second board 22 (FIG. 1B) representing, in miniature, the second, or "back" nine holes of a full-scale golf course.

The game boards 20 and 22 each include, for each hole, appropriate pictorial representations of a tee 24, a green 26 distant from the tee 24, and a fairway 28 generally extending between the tee and the green. Throughout this disclosure, it will be understood that reference, in general terms, to elements appearing on the game board 20 would also be taken to mean similar elements indicated on game board 22, unless specific elements are called out below for purposes of explanation in specific instances.

The game boards 20 and 22 also present appropriate pictorial representations of a plurality of troubles: first, those troubles represented by reference numeral 30 to indicate troubles positioned on the fairway 28; then, those troubles represented by reference numeral 32 to indicate troubles positioned adjacent to the fairway; and, finally, those troubles represented by reference numeral 34 to indicate troubles positioned distant from the fairway. Notwithstanding the particular troubles represented by the reference numerals 30, 32, and 34, those troubles appearing on the game boards 20 and 22 are of a large variety of forms typical of those normally encountered on a regular golf course including trees, woods, bunkers, lost ball, embedded ball, brush, water hazard, grass of varied lengths, fringe of green, and out of bounds.

Additionally, those fairways presented on each of the game boards 20 and 22 are provided with distance indicia 35 at preselected intervals along the fairway to denote distance from the green. The distance indicia 35 are yard markings, in part, in the form of a series of successive short lines 36, extending generally transverse, at regular intervals, of an imaginery line connecting tee 24 and the green 26 at opposite ends of each fairway 28. The distance between each successive pair of short lines 36 is equivalent to 20 yards. The distance indicia 35 are also, in part, in the form of a series of successive dots 37 representing 10 yard increments between each dot and its adjacent short line 36.

Figure 3:
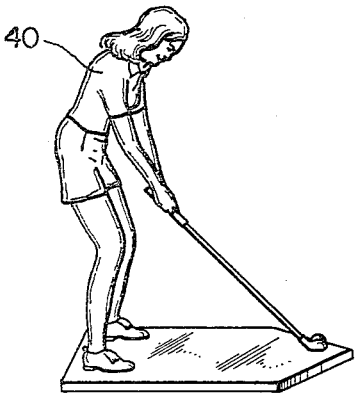
FIG. 3 is a perspective view of a game piece representative of a woman golfer.
Figure 2:
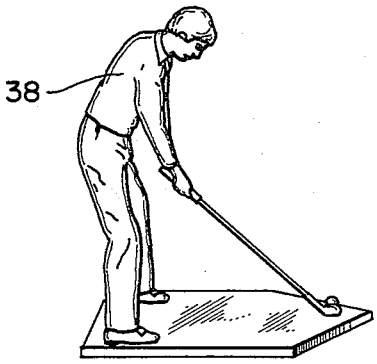
FIG. 2 is a perspective view of a game piece representative of a man golfer.
Figure 4:
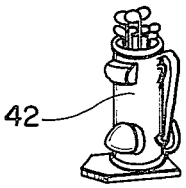
FIG. 4 is a perspective view of a game piece which is used during the play of the game under certain conditions in conjunction with the game pieces illustrated in FIGS. 2 and 3.

At least one ball marker is utilized in the play of the game, a ball marker 38 (FIG. 2) representing a man player and a ball marker 40 (FIG. 3) representing a woman player. A fairway marker 42 (FIG. 4) is utilized when a player's ball is in a trouble situation and, when such is the case, the fairway marker 42 is placed at the proper yard mark on the fairway and the appropriate ball marker 38 or 40 is placed in the trouble area.

Figure 6:
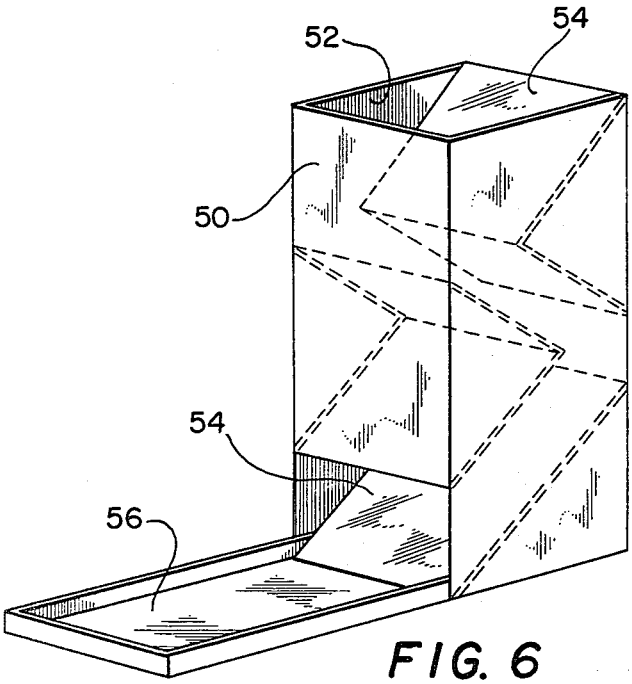
FIG. 6 is a perspective view of a dice scrambler which may be utilized by the players of the game.
Figure 5A:
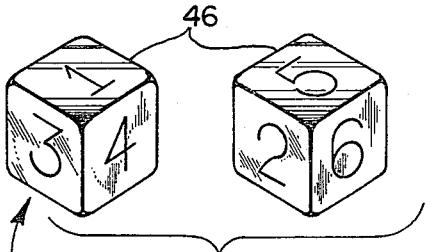
FIG. 5A is a perspective view illustrating the six faces of one of a pair of dice which are collectively referred to as first chance means.
Figure 5B:
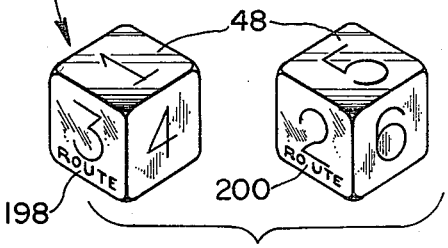
FIG. 5B is a perspective view illustrating the six faces of another of a pair of dice which are collectively referred to as first chance means.

Turning to FIGS. 5A and 5B, first chance means 44 are provided for manipulation by a player for randomly generating numbers. As illustrated, the first chance means 44 are in the form of a pair of conventional six-sided dice 46 and 48, preferably uniform in color, the sides of the dice being numbered, respectively, one through six. However, although dice 46 and 48 have been illustrated in the drawings and are referred to in this disclosure, it should be understood that the invention is not to be limited to the use of dice for randomly generating numbers. Indeed, any suitable mechanism or device for randomly generating numbers of the quality to be described can be used in playing the game and should be considered to be within the scope of the invention. In keeping with the concept of using dice, the dice scrambler 50 (FIG. 6) may be employed for shaking up or scrambling the dice as a player takes his turn. For this purpose, the dice 46 and 48, and others to be described, may be tossed into an upper opening 52 of the scrambler and descend through a plurality of baffles 54, finally coming to rest on a lower platform 56. For purposes of the invention, the numbers generated by the dice 46 and 48 are read as having two digits, the first of the digits being equal to or greater than the second of the digits. The application to the game of such numbers as are generated will be explained in detail below.

Figure 7A:
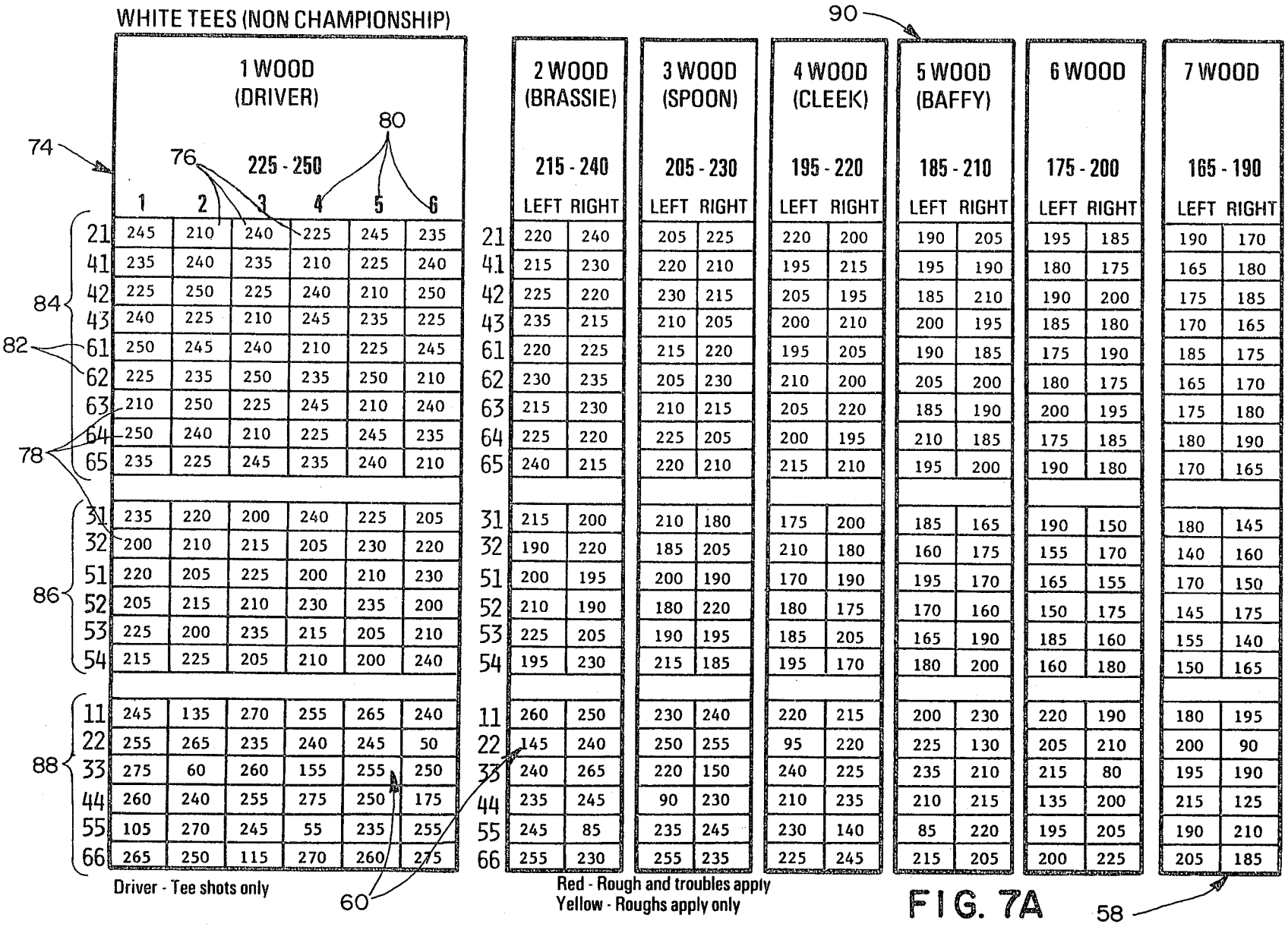
FIG. 7A is an example of a part of a first source of information utilized in the game, namely, the CLUB CARD, side one.

With reference now to FIGS. 7A and 7B, a first source of information, also referred to as a CLUB CARD, is generally indicated by reference numeral 58 which includes separate sets of number indicia 60 thereon relating to each of a plurality of clubs as arbitrarily chosen by a player prior to tossing the dice 46 and 48. The particular example illustrated in FIGS. 7A and 7B is that for the "white tees", that is, for players of non-championship competence level. The number indicia 60 signify travel of a player's ball when using a particular club according to the numbers generated in response to tossing of the dice 46 and 48.

For the play of the game, one of three different CLUB CARDS is arbitrarily chosen by each player. The number indicia 60 are representative, in one instance, of actual golfers of non-championship competence level, in another instance, of men golfers of championship competence level, and in still another instance, of women golfers of championship competence level. Once a player has chosen a CLUB CARD 58 for a particular level of competence, he must continue to use that specific CLUB CARD for the entire game. As seen in FIG. 7A, which presents side one of the CLUB CARD 58, the number indicia 60 are presented in separate sets or groups relating, respectively, to woods 1 through 7, to irons 1 through 9, and to a pitching wedge. In each set, below the club name and number, is the yard range which generally applies to the particular club selected. The number indicia 60 represent the distance the ball travels in response to the toss of the chance means. The particular manner in which a specific number of the number indicia 60 is chosen to represent the distance the ball travels will be explained below.

The CLUB CARD 58 also has a side 2, as illustrated in FIG. 7B, which will be described below.

Figure 8:
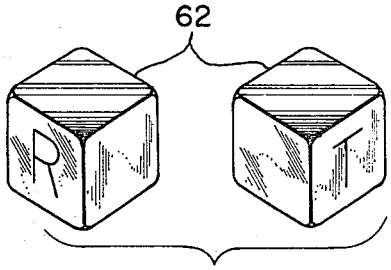
FIG. 8 is a perspective view illustrating the six faces of a die which is referred to as a second chance means.

Referring now to FIG. 8, a second chance means in the form of a die 62 is also provided for the play of the game. Preferably, the die 62 is different in color from the dice 46 and 48. The die 62 is conventional in that it has six sides, but unique in that one side is marked "R" to represent a rough area condition. Another of its sides is marked "T" to represent a trouble area condition, and the remaining four sides are provided without any distinguishing markings. When the die 62 is tossed through the scrambler 50 together with the dice 46 and 48, and the side of the die 62 containing either the "R" or the "T" faces upwardly, the player's ball is then subjected to a rough area condition or a trouble area condition, respectively. The specific effect of such an occurrence will be explained in greater detail below.

With reference now to FIGS. 9A and 9B, a second source of information, also referred to as a TROUBLE POSITION CARD, is generally indicated by reference numeral 64. The TROUBLE POSITION CARD includes trouble condition indicia, as indicated generally by reference numeral 66, designating a variety of troubles as already discussed at preselected intervals between the tee and the green corresponding to the distance indicia 35 and corresponding to the pictorial representations of those troubles on the game board 20 and 22. When a player tosses the dice 46, 48, and 62, and the die 62 indicates that the player's ball is subject to a trouble condition, the trouble condition indicia 66 on the TROUBLE POSITION CARD 64 will indicate the extent of the trouble condition dependent upon the numbers generated by the dice 46 and 48. There are eighteen TROUBLE POSITION CARDS provided for the play of the game, one for each hole, and side 1 is used to identify all of the trouble situations, and their locations, that exist between the tee and the green.

The TROUBLE POSITION CARD 64 also has a side 2, as illustrated in FIG. 9B, which presents various sets of trouble result indicia generally indicated by respective reference numerals 68, 69, and 70, which apply when a player attempts to remove his ball from the trouble condition. All numbers comprising the trouble result indicia 68, 69, and 70 are expressed in yards unless they are specifically recited in terms of feet. The particular manner of using each side of the TROUBLE POSITION CARD 64 will be explained in greater detail below.

In accordance with the invention, the game is generally as previously described including third chance means for manipulation by a player for randomly generating numbers having one digit, one of said sets of number indicia of said first source of information relating to a driver club being in the form of a driver matrix, said number indicia of said driver matrix signifying travel of the player's ball according to a combination of the numbers generated in response to simultaneous manipulation of said first chance means and of said third chance means; wherein the numbers generated by said first chance means have two digits, the first of the digits being equal to or greater than the second of the digits; and wherein said driver matrix includes a plurality of columns and a plurality of rows, each of said columns having a heading number capable of being generated by manipulation of said third chance means and each of said rows having an identification number capable of being generated in response to manipulation of said first chance means, an intersection of said row and of said column defined, respectively, by said identification numbers and said heading numbers generated in response to manipulation of said first and third chance means resulting in designation of a specific one of said number indicia signifying travel of the player's ball.

Figure 10:
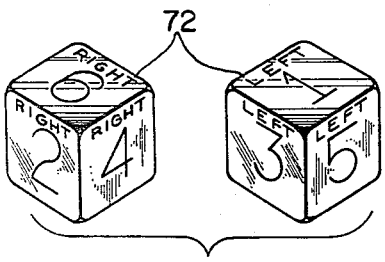
FIG. 10 is a perspective view illustrating the six faces of a die which is referred to as third chance means.

As embodied herein, with reference now to FIG. 10, third chance means in the form of a die 72 is also provided for the play of the game. Preferably, the die 72 is different in color from the dice 46, 48, and 62. The die 72 has a plurality of faces numbered such that manipulation by a player results in the random generation of numbers having one digit.

Turning to FIG. 7A, one of the sets of number indicia 60 appearing on the CLUB CARD 58 is in the form of a driver matrix 74 and relates to the use by a player of the driver or 1 wood club, the number indicia 60 of the driver matrix 74 signifying travel of the player's ball according to a combination of the numbers generated in response to a simultaneous toss by the player of the dice 46, 48, and 72. As previously explained, the numbers generated by the dice 46 and 48 have two digits which are read in such a manner that the first of the digits is equal to or greater than the second of the digits.

With continuing reference to FIG. 7A, the driver matrix 74 is seen to include a plurality of columns 76 and a plurality of rows 78, each of the columns 76 having a heading number 80 capable of being generated upon the toss of the die 72 and each of the rows 78 having an identification number 82 capable of being generated by a toss of the dice 46 and 48. Thus, when the dice 46, 48, and 72 are tossed together, an intersection of the row 78 defined by the particular identification number 82 resulting from the toss of the dice 46 and 48 and of the column 76 defined by the particular heading number 80 resulting from the toss of the die 72 thereby resulting in designation of a specific one of the number indicia 60 signifying travel of the player's ball as it advances from the tee to the green.

In accordance with the invention, the game is generally as previously described wherein said driver matrix includes six columns and 21 rows and wherein the numbers generated by said first chance means have two digits, the first of the digits being equal to or greater than the second of the digits, and wherein said driver matrix includes first, second, and third sections, said first section having nine rows, said second section having six rows, and said third section having six rows, said identification numbers for said first section being, sequentially, those numbers having even first digits of ascending value coupled with second digits of ascending value, said identification numbers for said second section being, sequentially, those numbers having odd first digits of ascending value coupled with second digits of ascending value and said identification numbers for said third section being, sequentially, those numbers of ascending value having identical first and second digits.

As embodied herein, with continuing reference to FIG. 7A, the driver matrix 74 is seen to include six columns 80 and 21 rows 78. Indeed, the driver matrix 74 is further divided into three sections including a first section 84 having nine rows, a second section 86 having six rows, and a third section 88 also having six rows. The identification numbers 82 for the first section 84 are, in sequence from top to bottom of FIG. 7A, those numbers having even first digits of ascending value coupled with second digits of ascending value; the identification numbers 82 for the second section 86 being, in sequence, those numbers having odd first digits of ascending value coupled with second digits, whether even or odd, of ascending value; and the identification numbers 82 for the third section 88 being, in sequence, those numbers of ascending value, both odd and even, but having identical first and second digits.

In accordance with the invention, the game is generally as previously described including third chance means for manipulation by a player for randomly generating numbers having one digit, said set of number indicia of said first source of information relating to clubs other than said driver club being in the form of a club matrix for each respective club having left and right columns and wherein odd numbers generated in response to manipulation of said third chance means define said left column and wherein even numbers generated in response to manipulation of said third chance means define said right column, said club matrix including a plurality of rows, each of said rows having an identification number capable of being generated in response to manipulation of said first chance means, an intersection of said row and said column defined, respectively, by said identification numbers and said heading numbers generated in response to manipulation of said first and third chance means resulting in designation of a specific one of said number indicia signifying travel of the player's ball.

As embodied herein, with continuing reference to FIG. 7A, the number indicia 60 of the CLUB CARD 58 relating to clubs other than the driver club are in the form of a club matrix 90 as generally indicated with respect to the pitching wedge. However, it is to be understood that the club matrix 90 is a general form descriptive of the information relating to any of the other clubs presented on the CLUB CARD 58 in FIG. 7A. Specifically, the club matrix 90 for each respective club has a left column 92 and a right column 93. Odd numbers generated in response to tossing of the die 72 define when the left column 92 is to be used in the play of the game and even numbers, similarly generated, define when the right column 93 is to be used. In this regard, it will be noted that those sides of the die 72 provided with an odd number are further marked with the word "left"; and those sides of the die 72 provided with an even number are further marked with the word "right". By so doing, the toss of the die 72 determines whether the left column 92 applies, or whether the right column 93 applies. This concept is carried throughout the game and is utilized with respect to other sources of information about to be described. Additionally, the club matrix 90 includes a plurality of rows 94, and each of the rows has an identification number 95. As previously discussed with respect to the identification numbers 82 of the driver matrix 74, the identification numbers 95 of the club matrix 90 are capable of being generated in response to tossing of the dice 46 and 48. Also, similar to the case of the driver matrix 74, an intersection of a row 94 with a column 92 or 93 after the player tosses the dice 46, 48, and 72, results in designation of a specific one of the number indicia 60 signifying travel of the player's ball.

Also, similar in form to the matrix 74, the matrix 90 has 21 rows divided into a first section 96 having nine rows, a second section 98 having six rows, and a third section 100 also having six rows. The identification numbers 95 which relate to the club matrix 90 are identical to those already described with respect to matrix 74.

The general assumptions utilized in the formation of that part of the CLUB CARD 58 illustrated in FIG. 7A will now be discussed. It is common knowledge that each club utilized in the play of the outdoor game of golf has a range that the ball travels as an average. This range is listed at the top of the driver matrix 74 with respect to the 1 wood and is listed at the top of each club matrix 90 with respect to each of the other clubs used in the course of playing the game, as represented in FIG. 7A. Side one of the CLUB CARD 58 (FIG. 7A) is so arranged that the first sections 84 and 96 recite number indicia 60 which include only those numbers falling within the average or normal range of the particular club as listed at the top of each club matrix. More particularly, all of the numbers recited within the sections 84 and 96 fall within a range of values generally indicative of a particular club used by a person having the level of competence as provided by the CLUB CARD 58, that is, whether the player is playing as a man golfer or as a woman golfer and whether the player is playing as a championship golfer or a non-championship golfer. Statistically, the player has an optimum chance, upon tossing the dice 46, 48, and 72, of obtaining a number within the first sections 84 or 96.

In the same manner, those number indicia 60 included in the second sections 86 and 98 of the matrices 74 and 90, respectively, include numbers falling below the normal range for the particular club. Statistically, the player has only a moderate chance of hitting a number within sections 86 and 98.

With respect to the third sections 88 and 100, the number indicia 60 relate to numbers either above the range or extremely below the range normal for the particular club. Statistically, the player has the least chance of hitting a number within these sections.

The ranges of values for the number indicia 60 for the non-championship players are based on research which includes Golf Magazine, Encyclopedia of Golf, golf periodicals, and books published by professional golfers. Ranges for the championship levels of play are based on studies of many golfers as described by sports announcers, writers and commentators covering professional tours for the media. The ranges provided for the championship levels of play do not imply that these are the farthest distance that professional golfers hit a ball, but only represent an average and accurate stroke. In any event, the ranges of each club in each section vary 20 yards or more to imply different conditions which might exist during the stroke, for example, wind, ground conditions, undulated fairways and greens and the like.

It is also noteworthy that a primary purpose of the third chance means or die 72 is to increase the possibilities made available to the players of the game. With respect to the driver club, such possibilities, as represented by the number indicia 60, are increased six-fold while they are doubled with respect to the other clubs. The possibilities as represented by the number indicia 60A on side 2 of the CLUB CARD 58 are similarly doubled. The die 72 performs a similar role with respect to indicia incorporated into other sources of information yet to be described.

In accordance with the invention, the game is generally as previously described wherein said first source of information includes a plurality of groups of number indicia relating to each of a plurality of appropriate ranges of distances arbitrarily chosen by a player prior to manipulation of said chance means, said groups signifying travel of the player's ball when a particular one of said ranges of distances has been chosen, according to the numbers generated in response to manipulation of said first chance means.

As embodied herein, with reference now to FIG. 7B which illustrates side 2 of the CLUB CARD 58, separate sets of number indicia 60A are provided in a format similar to side 1 (FIG. 7A) for long chipping, mid chipping, short chipping, and fringe putting. Each of these sets of number indicia 60A is in the form of a chipping and fringe putting matrix 101 which may be selected by a player according to the distance desired to be achieved. The matrices 101 are specifically provided for those situations occurring when the player desires to advance the ball less than the range of the pitching wedge, and then the player chooses, before tossing the dice 46, 48, 62, and 72, a specific range of distances and uses an appropriate matrix 101 which he considers best applies to his situation. All of the numbers of the number indicia 60 are expressed in yards except for those within the short chipping and fringe putting matrices which are expressed in feet. A player, when short chipping or fringe putting, is required to use the appropriate columns with the exact yardage distance from the hole. The fringe putting matrices are used when a player's ball lands on the fringe as determined by the trouble condition indicia 66 on the TROUBLE POSITION CARD 64 or by the HOLE POSITION CARD which will be described below.

In any event, it should be understood that the matrices 101 are not club selections as intended on side 1 of the CLUB CARD 58. Rather, the matrices 101 provide independent indicia 60A of chipping distances. Indeed, any club could be selected during the real play to "chip" a short distance. For this reason, no one club, as such, is actually utilized. Instead, for purposes of the game, a range of distances as embodied in the matrices 101 has been developed to depict the chipping of a player as he approaches the hole.

In accordance with the invention, the game is generally as previously described including third chance means for manipulation by a player for randomly generating numbers having one digit, said trouble condition indicia of said second source of information being in the form of a first trouble matrix having left and right sets of columns, said left set signifying the extent of said trouble to the player's ball upon manipulation of said third chance means resulting in generation of an odd number, said right set signifying the extent of said trouble to the player's ball upon manipulation of said third chance means resulting in generation of an even number and including a plurality of rows, each of said rows having distance numbers corresponding sequentially to said distance indicia, an intersection of said row containing a specific one of said distance numbers as determined from said number indicia of said first source of information in response to manipulation of said first chance means and of said column defined by the result of manipulation of said second and third chance means resulting in designation of a specific one of said trouble condition indicia to which the player's ball is subjected.

As embodied herein, with reference initially to FIG. 9A, that is, side 1 of the TROUBLE POSITION CARD 64, a first trouble matrix 102 includes a left set 104 of columns to be discussed below and a right set 106 of columns also to be discussed below. The left set 104 signifies the extent of a trouble to the player's ball after a toss by the player of the die 72 resulting in the generation of an odd number and the right set 106 signifies the extent of a trouble to the player's ball after the toss of an even number. The first trouble matrix also includes a plurality of rows 108 each of which has a distance number 110 corresponding sequentially to the distance indicia 35 on the game boards 20 and 22. Thus, when the dice 46, 48, 62, and 72 are tossed together, a specific one of the trouble condition indicia 66 will have been determined to apply to the player's ball. The manner in which this is achieved will now be explained. Using the CLUB CARD 58, the toss of the dice 46 and 48 together with the die 72 determine the distance that the player's ball has achieved as the result of a stroke. This distance is read as a distance number 110 on the TROUBLE POSITION CARD 64 (FIG. 9A). In this fashion, a particular row 108 is determined. Simultaneously, the left set 104 or the right set 106 of columns is determined from the roll of the die 72.

In accordance with the invention, the game is generally as previously described wherein said left and right sets each include a column designating said troubles, respectively, as situations existing on said fairway, as situations existing in a rough area adjacent to said fairway, and as situations existing in a trouble area adjacent to said rough area and distant from said fairway, all according to the indication resulting in response to manipulation of said second chance means.

As embodied herein, with continuing reference to FIG. 9A, the left set 104 includes a column 112 designating troubles 30 generally existing on the fairway, and as illustrated on the game boards 20 and 22; a column 114 designating those troubles 32 generally referred to as a "rough area" corresponding with a roll of "R" on the die 62 and in keeping with those trouble areas adjacent to the fairway 28 as illustrated on the game boards 20 and 22; and a column 116 designating those troubles 34 generally referred to as a "trouble area" corresponding with a roll of "T" on the die 62 and in keeping with those trouble areas adjacent to the troubles 32 and distant from the fairway 28. It should be noted that the columns 112, 114, and 116 for a right set 106 are identical in concept to those for a left set 104.

Thus, following the roll of the dice 46, 48, 62, and 72, and while a player's ball is still short of the green 26, a particular trouble occurring to a player's ball, if any, can be determined from the TROUBLE POSITION CARD 64.

In accordance with the invention, the game is generally as previously described wherein said second source of information includes a plurality of second trouble matrices signifying the result of an attempt by a player to retrieve his ball from a trouble situation according to the numbers generated in response to a subsequent manipulation of said first chance means and according to the designation of a specific one of said trouble condition indicia to which the player's ball is already subjected, and wherein certain parts of said second trouble matrices are in the form of numbers, and wherein certain parts of said second trouble matrices are in the form of words, and wherein certain parts of said second trouble matrices are alphanumeric in form, and wherein certain parts of said second trouble matrices are symbols other than numbers or of alphanumeric form.

As embodied herein, with reference now to FIG. 9B, side 2 of the TROUBLE POSITION CARD 64 is illustrated and presents a plurality of second trouble matrices generally indicated by the reference numerals 118 to indicate roughs in a general sense 119 to indicate roughs around the green, 120 to indicate trees, 122 to indicate woods, 124 to indicate bunkers, 126 to indicate a rock on the fairway, and 128 to indicate that the ball has landed adjacent to the green but on the wrong hole. In short, side 2 of the TROUBLE POSITION CARD 64 represents the stroke needed to come out of roughs, trees, woods, bunkers, and other holes. The rough matrix 118 has four rough adjustment columns, respectively, column 130 representing brush, column 132 representing long grass, column 134 representing medium length grass, and column 136 representing short grass. If side 1 of the TROUBLE POSITION CARD 64 (FIG. 9A) indicates that a player is in a "rough med." area, then the player adjusts the club selection from the "rough med." column (that is, column 134 on side 2). To make the rough adjustment, the player reviews column 134 to estimate the extra yardage needed to compensate for coming out of the rough on the next stroke. For the player's stroke, the estimated yardage is added to the distance the ball must travel before making the preferred club selection from the CLUB CARD 58. For example, assume the player's ball must travel 160 yards to the hole, but lies in a "rough med." trouble condition. The player reviews the "rough med." column 134 and estimates a 10 yard adjustment and the 10 yard adjustment is added to the 160 yards to compensate for coming out of the rough. When using the CLUB CARD 58 for non-championship play, a 6 iron would commonly be selected for a 160 yard stroke, but by adding the 10 yard adjustment to the 160 yards, the player selects the 5 iron for the 170 yard stroke. For the stroke, the dice 46, 48, and 72 are tossed. If they are read "63, left", reference to the CLUB CARD will provide specific number indicia 60 of 180 yards. At the same time, reference to the rough matrix 118 and specifically to the column 134 will advise the player of the trouble result indicia 68 which is an adjustment of minus 15 yards. This adjustment is then subtracted from the 180 yards for a distance of 165 yards that the ball actually is permitted to travel.

Note that as with the CLUB CARD 58, the TROUBLE POSITION CARD, side 2 (FIG. 9B) is arranged with each of the matrices having 21 rows 138 and each of the rows having an identification number 140 capable of being generated by a toss of the dice 46 and 48. Also, similar to the matrices 74 and 90, the matrix 118, for example, is divided into a first section 142 having nine rows, a second section 144 having six rows, and a third section 146 also having six rows. The matrices, 119, 120, 122, 124, 126, and 128 are of a similar format.

All of the trouble result indicia 68, 69, and 70 appearing on the TROUBLE POSITION CARD, side 2, are indicated in yards except when the troubles are near the green and in those instances, the indicia are represented in feet. Some of the trouble result indicia 68, 69, and 70 specify locations, lost balls, ponds, fringes, and the word "in" which indicates the ball landed in the hole. Those indicia which read "fringe" and a number indicate that the ball is in the fringe but at the specified yard section of the green. For example, "FRINGE 5" is the fringe area equal to the "GREEN" 5 yard section. An indicia in the form of a downward arrow, as in the trees matrix 120 and wood matrix 122, indicates the ball ricocheted off a tree or object and denotes its results. Indicia 68, 69, and 70 in the form of a minus number advises the yardage loss under ricocheted conditions. A study of side two of the TROUBLE POSITION CARD 64 will also disclose that, in general, the trouble result indicia 68 are adjustments to a stroke while the trouble result indicia 69 and 70 indicate, in and of themselves, placement of the ball or the effect to the ball following a stroke. Also, in some instances, the trouble result indicia 69 and 70 indicate yet a further trouble situation to which the ball is subjected. In any event, in certain instances the trouble result indicia are in the form of numbers alone or words alone, and in certain other instances they are alphanumeric in form, and in certain other instances, still, the indicia are in the form of symbols other than numbers, words or of alphanumeric form.

The theory behind the matrix 118 and its other associated matrices on side 2 of the TROUBLE POSITION CARD 64 (FIG. 9B) is similar to that previously described with respect to the CLUB CARD 58. Hence, a player tossing the dice 46, 48, and 72 has an optimum chance of achieving one of the trouble result indicia 68, 69, or 70 within the first section 142. Indeed, all of the trouble result indicia appearing within the first section 142 of the roughs matrix 118, for example, are the optimum numbers for negative adjustment of the player's stroke in attempting to come out of a trouble condition. Similarly, the player has only a moderate chance of achieving one of the trouble result indicia within the second section 144 and all of the indicia recited within the section 144 represent less than optimum numbers for negative adjustment of the player's stroke in attempting to come out of a trouble condition. Finally, the player has only a minimum chance of achieving indicia lying within the third section 146, and all of the indicia recited in that section are either the least optimum numbers or the very best numbers for negative adjustment of the player's stroke in attempting to come out of a trouble condition.

With respect to the CLUB CARD 58, it is within the purview of the invention to mark certain of the sections 84, 86, and 88 of the driver matrix 74 in a distinguishing fashion (not shown), for example, by coloring them yellow, to indicate that the ball is subject to a rough area only, even if a "T" appears upon a throw of the die 62. Similarly, certain sections 84, 86, and 88 of the driver matrix 74 may be marked in another distinguishing fashion, for example, by coloring them red, to indicate that the ball is subject to both rough areas and trouble areas such as might be indicated upon a throw of the dice. Such distinctive markings (not shown) may also be applied to sections 96, 98, and 100 of the club matrices 90 as well as to the sections of the chipping and fringe putting matrices 101. These markings can be applied in a preselected manner to the CLUB CARD 58 for each competence level of player to thereby achieve still a further differentation between championship players and non-championship players. Such an expedient also serves to increase the numbers of possibilities in the play of the game.

In accordance with the invention, the game is generally as previously described, including third chance means for manipulation by a player for randomly generating numbers, and wherein said green includes a plurality of hole positions, each of said hole positions being identified by a hole position number capable of being generated in response to manipulation of said third chance means.

Figure 11:
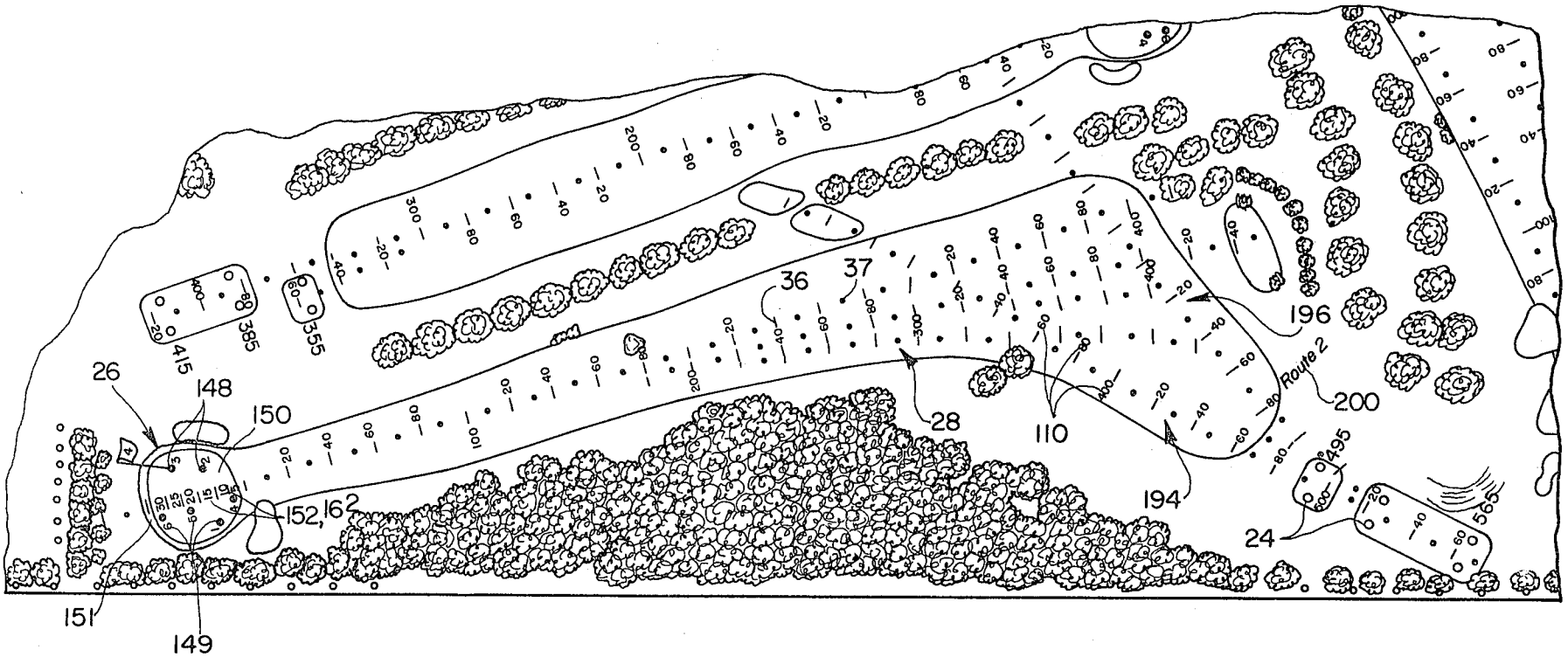
FIG. 11 is a detail top plan view of a part of the game board illustrated in FIG. 1A.

As embodied herein, with particular reference now to FIGS. 1A and 10, each green 26 on the game boards 20 and 22 is provided with a plurality of hole positions 148 each of which is identified by a hole position number 149 (see FIG. 11). As previously, the third chance means is presented in the form of the die 72 which has appropriate numbers on each of its sides corresponding to the numbers 149 of the respective hole positions 148 on the green 26. Also, as previously explained, in the embodiment illustrated, the die 72 is provided with six sides respectively numbered 1–6. Conforming with the die 72, then, the green 26 is provided with six hole positions 148, similarly numbered. At the outset of play of the game, a player tosses the die 72 to determine which hole position 148 will be used. The number tossed by the die 72 thus indicates the particular hole position to be employed throughout play of that particular game, regardless of the green being played on.

In accordance with the invention, the game is generally as previously described, wherein said green includes a green area and a fringe area at least partially surrounding and proximate to said green area, said fringe area having fringe distance indicia for signifying the location of the player's ball thereon, said green area having hole distance indicia for signifying the location of the player's ball thereon, and including a third source of information corresponding to a particular one of said hole positions including hole distance indicia and fringe distance indicia for signifying the location of the player's ball, in some instances, on said green area and in some other instances on said fringe area occurring in response to manipulation of said first chance means.

Figure 12:
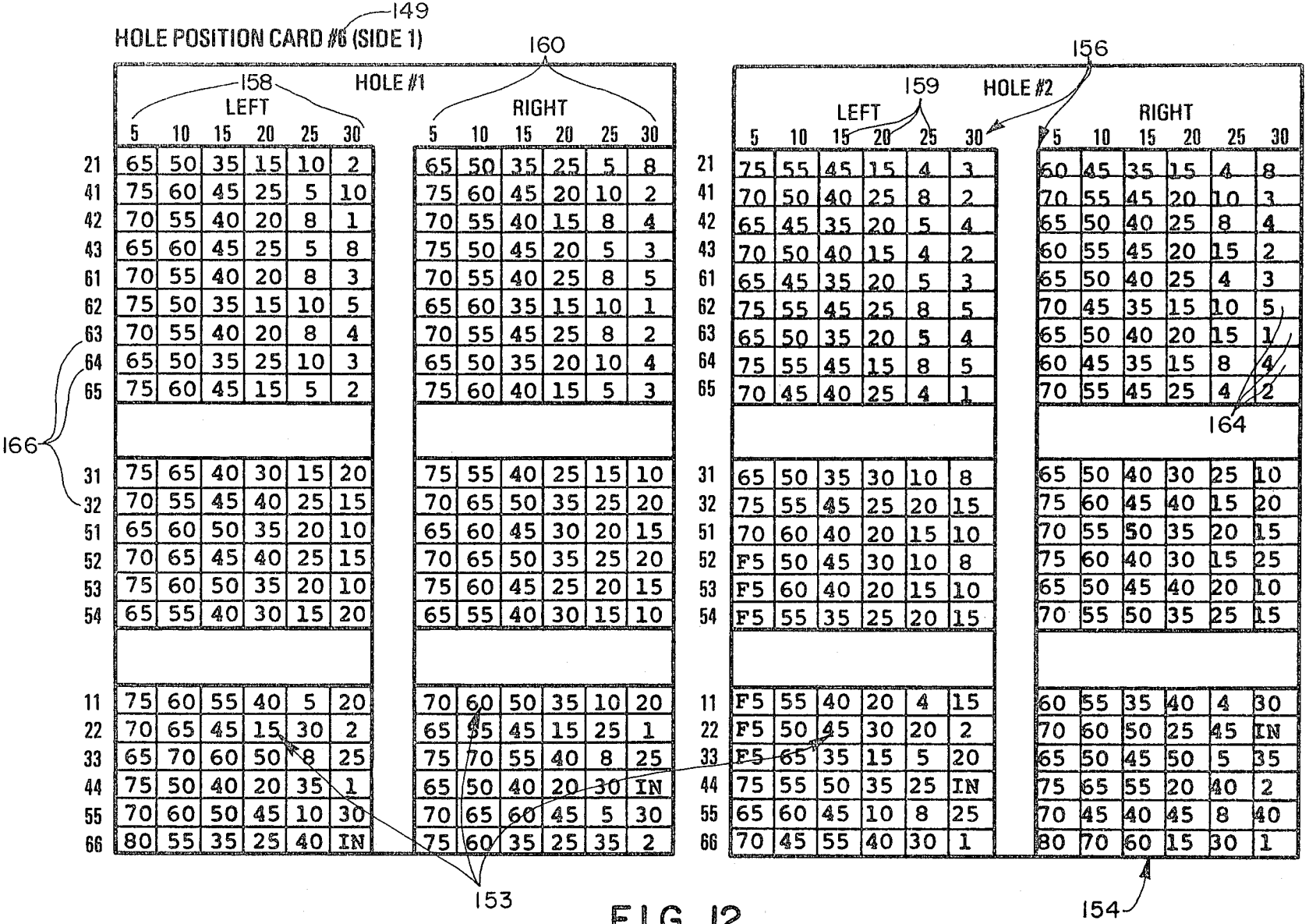
FIG. 12 is an example of a part of a third source of information utilized in the game, namely, the HOLE POSITION CARD, side one.

As embodied herein, with reference now to FIGS. 11 and 12, each green 26 (FIG. 11) is understood to mean, inclusively, a green area 150 which is in fact the putting surface, and a fringe area 151 which at least partially surrounds the green and, in instances of elevated greens, completely surrounds the green. Fringe distance indicia 152 are utilized to signify the distance, expressed in yards, between that portion of the green nearest its associated tee and that portion of the green farthest from its associated tee. As seen in FIG. 11, for ease of illustration, they are actually imprinted on the green area 150. Similarly, hole distance indicia 153 are provided on the green area 150 to signify the distance, expressed in feet, from the hole. A third source of information, also referred to as a HOLE POSITION CARD, is generally indicated by reference numeral 154 (FIG. 12). For play of the game, there are six HOLE POSITION CARDS 154 each representing one of the hole positions 148 previously selected by toss of the die 72 and including the hole distance indicia 153 for signifying the position of the player's ball on the green 26 in terms of distance in feet from the hole when the ball lands on the green after a toss of the dice 46 and 48. Although each HOLE POSITION CARD 154 actually includes hole distance indicia 153 for each of the eighteen holes of a golf course, for ease of illustration, indicia 153 are only shown in FIG. 12 for the first four holes.

In accordance with the invention, the game is generally as previously described, wherein said green includes a green area and a fringe area at least partially surrounding and proximate to said green area, said green area including hole distance indicia for signifying the location of the player's ball thereon, said fringe area having fringe distance indicia for signifying the location of the player's ball thereon, and including third chance means for manipulation by a player for randomly generating numbers having one digit and including a third source of information having hole distance indicia and fringe distance indicia in the form of a hole position and fringe distance matrix having left and right sets of yard columns, said left set signifying the location of the player's ball on said green in response to manipulation of said third chance means resulting in generation of an odd number, said right set signifying the travel of the player's ball on said green in response to manipulation of said third chance means resulting in generation of an even number, and wherein the numbers generated by said first chance means have two digits, the first of the digits being equal to or greater than the second of the digits, and wherein said hole position and fringe distance matrix has a plurality of yard columns and 21 rows, said hole position and fringe distance matrix including first, second, and third sections, said first section having nine rows, said second section having six rows, and said third section having six rows, each of said rows having an identification number capable of being generated in response to manipulation of said first chance means, said identification numbers for said first section being, sequentially, those numbers having even first digits of ascending value coupled with second digits of ascending value, said identification numbers for said second section being, sequentially, those numbers having odd first digits of ascending value coupled with second digits of ascending value, and said identification numbers for said third section being, sequentially, those numbers of ascending value having identical first and second digits, each of said yard columns including a yard heading corresponding to the distance, in yards, between placement of the player's ball in response to the prior manipulation of said first chance means and the location of said hole and including a plurality of rows, an intersection of said row containing said identification number as determined in response to manipulation of said first chance means and of said yard column containing said yard heading as determined by the prior manipulation of said first chance means resulting in designation of a specific one of said hole distance indicia and said fringe distance indicia signifying distance of the player's ball from the hole on said green.

As embodied herein, reference is made initially to FIG. 10 illustrating the die 72 for randomly generating a number having one digit and to FIG. 11 which illustrates the green 26 having a plurality of hole positions, each of which is provided with a hole position number 149 capable of being generated by a toss of the die 72. Furthermore, as previously described, with reference to FIG. 12, the HOLE POSITION CARD 154 includes hole distance indicia 153. The indicia 153 take the form of a plurality of hole position matrices 156 each representing a separate hole of the eighteen hole golf course and each having a left set 158 of yard columns 159 which signify the travel of the player's ball on the green 26 upon a toss of the die 72 resulting in generation of an odd number, and a right set 160 of yard columns 159 which signify the travel of the player's ball on the green after toss by the player of the die 72 resulting in generation of an even number.

Furthermore, each of the yard columns 159 within the sets 158 and 160 is identified by a yard heading 162 corresponding to the difference, expressed in yards, between placement of the player's ball after the prior toss of the dice 46, 48, and the particular hole position 148. Each hole position matrix 156 also includes a plurality of rows 164, each such row having an identification number 166 capable of being generated by a toss of the dice 46, 48. Indeed, as with the driver matrix 74 and the club matrix 90 on the CLUB CARD 58, each hole position matrix 156 has 21 rows 164, each of the rows, as already explained, having an identification number 166 capable of being generated by a toss of the dice 46, 48. Also, similar to the matrices 74 and 90, each hole position matrix 156 is divided into a first section 168 having nine rows, a second section 170 having six rows, and a third section 172 also having six rows. In the play of the game, the distance of the player's ball from the hole is determined by the hole distance indicia 153, the specific number being evidenced by an intersection of the row 164 as determined in response to toss of the dice 46, 48 and of the particular yard column 159 containing a yard heading 162 as determined by the prior toss of the dice 46, 48. The specific one of the hole distance indicia 153 is thus determined as an expression, in feet, of the distance of the ball from the hole. Assume, for example, that the ball is already resting at the 30 yard mark on the hole #4 and that, subsequently, a throw of the dice 46, 48 results in the number "32" and the simultaneous throw of the die 72 results in the number "5". The resulting hole distance indicia 153 is the number "5"

which means that the ball is located 5 feet from the hole. By the same token, the fringe distance indicia is determined as an expression, in yards, of the distance that the ball has advanced proceeding from that portion of the green nearest its associated tee. For explanation, assume that the ball is already positioned as indicated above, namely, at the 30 yard mark on the hole #4, and that, subsequently, a throw of the dice 46, 48 results in the number "54" and the simultaneous throw of the die 72 results in the number "3". The resulting fringe distance indicia is the alphanumeric symbol "F30" which means that the ball is located on the fringe to the left of the green at the 30-yard mark. It will be appreciated that the yard headings 162 generally correspond to the fringe distance indicia 152, and are so indicated in FIG. 11.

The theory behind the hole position matrices 156 as presented on the HOLE POSITION CARD 154 (FIGS. 12A and 12B) is also similar to that previously described with respect to the CLUB CARD 58. Hence, a player tossing the dice 46, 48, and 72 has an optimum chance of achieving a specific one of the hole distance indicia 153 or fringe distance indicia 152 within the first section 168. Note that the hole distance indicia and fringe distance indicia within the first section 168 are the optimum numbers determining where the player's ball lies in the yard range of 5 to 30 yards for that hole position. Similarly, the player has only a moderate chance of achieving a specific one of the indicia 152 or 153 within the second section 170 and all of the indicia 152 or 153 recited within the second section 170 represent intermediate distances that a player's ball lies in the yard range of 5 to 30 yards for that hole position. Finally, the player has only a minimum chance of achieving a specific one of the indicia 152 or 153 lying within the third section 172, and all of the indicia 152 or 153 recited in that section are either the farthest distances that a player's ball lies in the yard range of 5 to 30 yards for that hole position, or are the very best distances.

In accordance with the invention, the game is generally as previously described including an enlarged pictorial representation of said green, separate from said game board, having an enlarged scale in relation to said game board and including a designation of a hole thereon and a fringe defining the outer limits of said pictorial representation and hole distance indicia at preselected radial intervals between said hole and said fringe to denote distance, in feet, from said hole.

As embodied herein, with reference again to FIG. 13, an enlarged pictorial representation 174 is provided of the green 26. The representation 174 is of a fixed shape and size not intended to be shaped as any one particular green 26 on the game boards 20 and 22. It is readily movable from one place to another and the ball markers 38, 40 are transferred from the game boards 20 and 22 to the representation 174 as soon as a player's ball finally lands on the green. The scale of the representation 174 is enlarged in relation to the greens 26 on the game boards and includes a designation of a hole 176 which is centrally located and the fringe area 151 which serves to define its outer limits. A plurality of the hole distance indicia 153 are provided on the representation 174 at preselected radial intervals between the hole 176 and the fringe 178 to denote distance, in feet, from the hole 176 and thereby enable a player to place his ball marker 38, 40 accordingly.

In accordance with the invention, the game is generally as previously described wherein said first chance means, upon manipulation, provide a pair of one digit numbers and including third chance means for manipulation by a player for randomly generating numbers of one digit and a fourth source of information including putting result indicia for signifying travel of the player's ball on said green in response to such manipulation, in sum of the numbers, of said first and third chance means, and wherein said fourth source of information includes a putting matrix having a plurality of putting distance columns, said putting matrix including sequential headings for each of said putting distance columns corresponding to the distance in feet of the player's ball from said hole as determined from said third source of information in response to manipulation of said first and third chance means, said putting matrix including a plurality of rows, each of said rows having an identification number capable of being the sum of the numbers generated in response to manipulation of said first and third chance means, said plurality of said identification numbers being in sequence, an intersection of said row containing said identification number as determined in response to manipulation of said first and third chance means and of said putting distance column resulting in designation of a specific one of said putting result indicia in response to manipulation of said first and third chance means.

Figure 13:
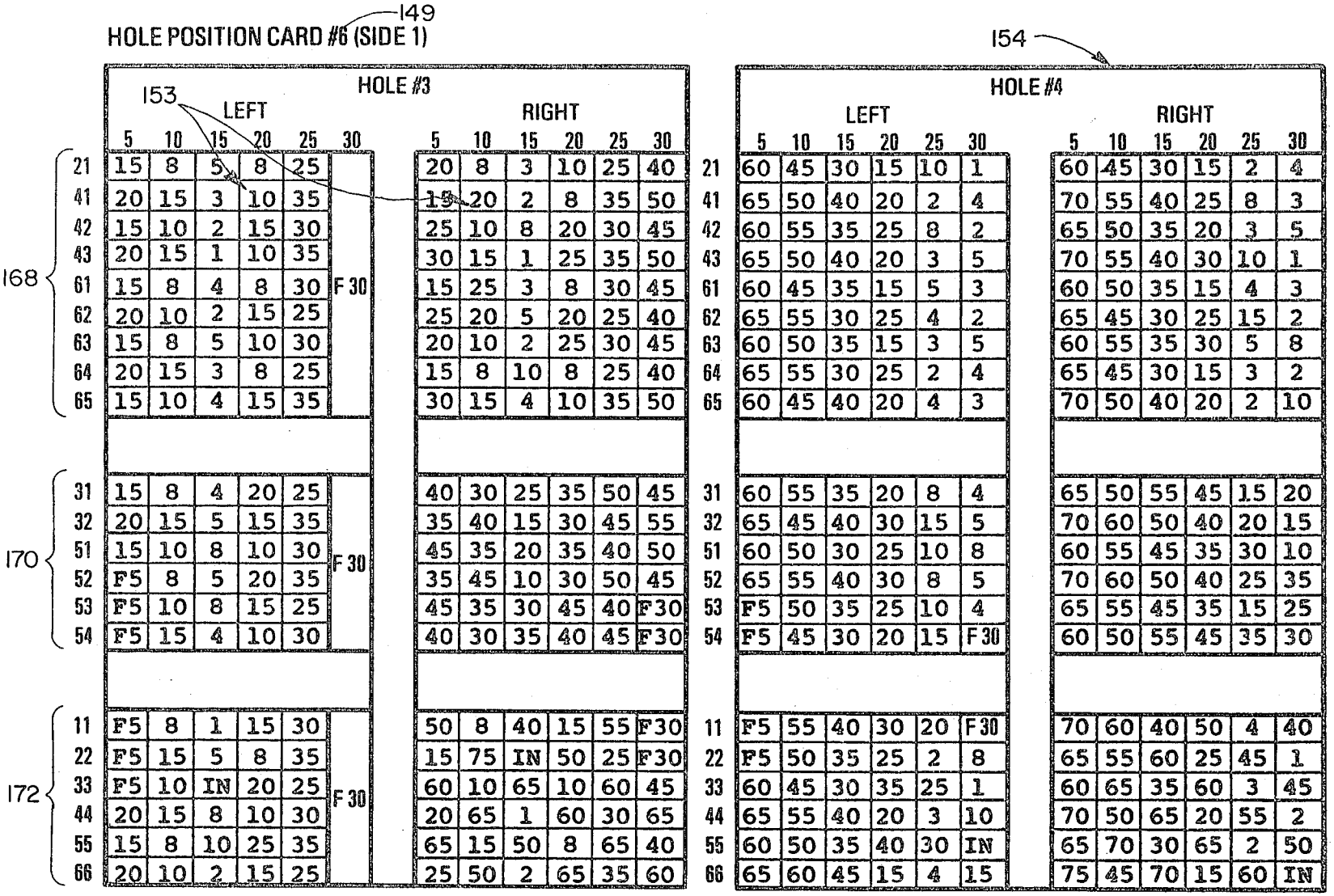
FIG. 13 is a top plan view of an enlarged green, separate from the game board, and representative of each of the greens appearing on the game board.
Figure 14:
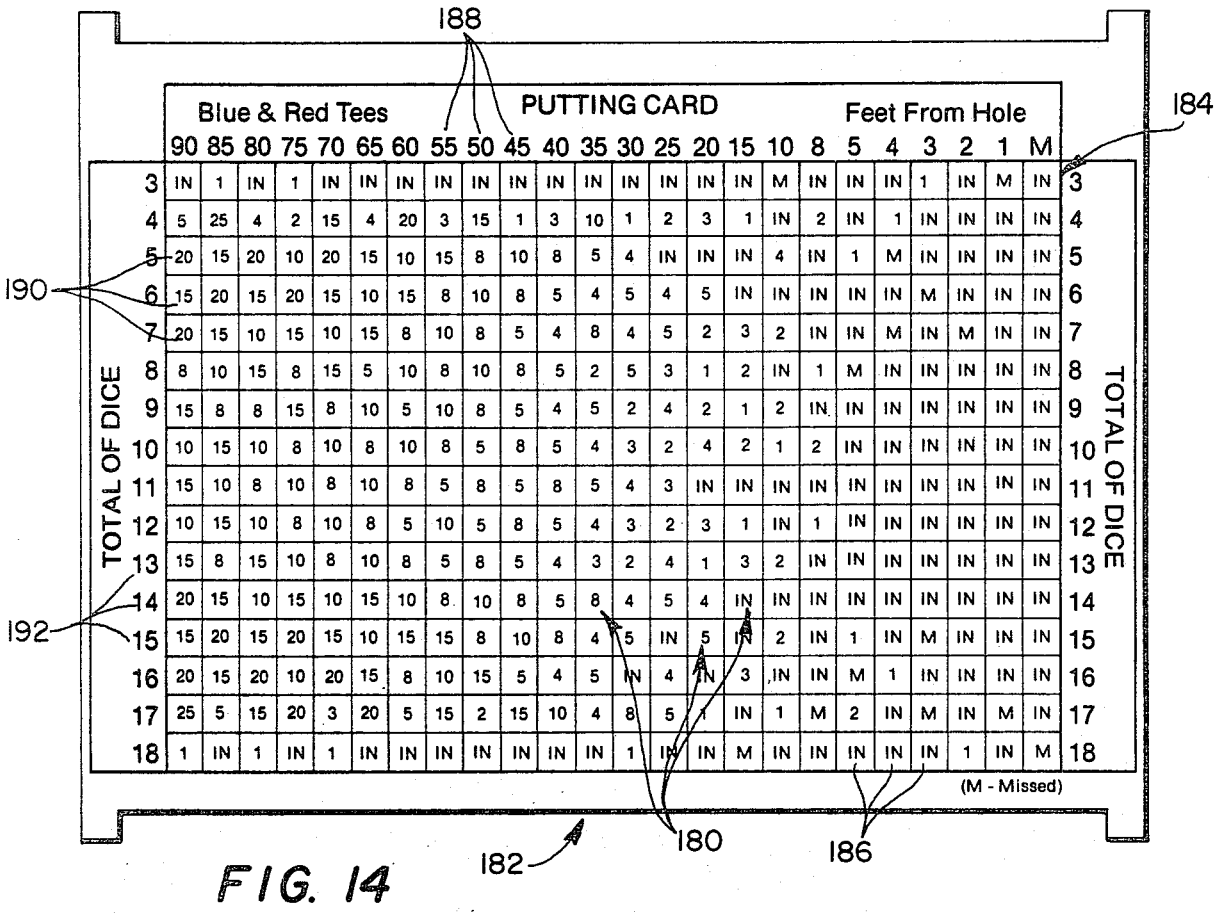
FIG. 14 is an example of a part of a fourth source of information utilized in the game, namely, the PUTTING CARD for non-championship play.
Figure 13:
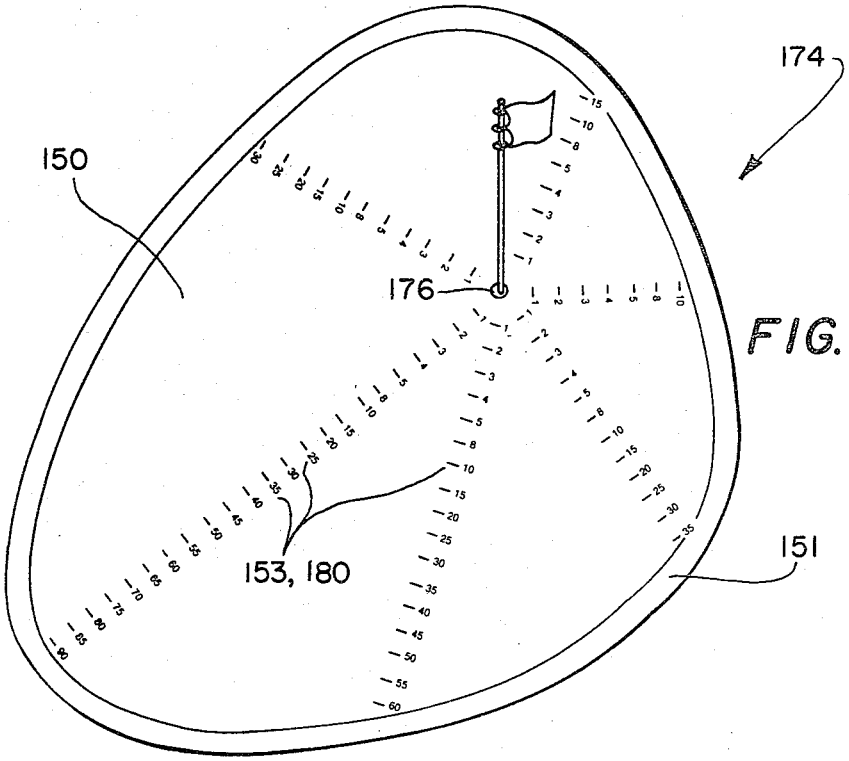

As embodied herein, with reference now to FIGS. 13 and 14, a fourth source of information 182, also referred to as a PUTTING CARD, includes a putting matrix 184 of the putting result indicia 180 having a plurality of putting distance columns 186 with sequential headings 188 provided for each of the putting distance columns 186. In each instance, the sequential heading 188 corresponds to the distance in feet of a player's ball from the hole 176 as determined from the HOLE POSITION CARD 154 after tossing the dice 46, 48, and 72. The putting matrix 184 also includes a plurality of rows 190, each row being provided with an identification number 192 capable of being the sum of the numbers generated in response to a toss of the dice 46, 48, and 72, the identification numbers 192 being in a consecutive sequence from the number "3" to the number "18". An intersection of a row 190 containing the identification number 192 as determined upon a toss of the dice 46, 48, and 72, and of the putting distance column 186 resulting in designation of a specific one of the putting result indicia 180, previously determined from the HOLE POSITION CARD 154, results in designation of a specific one of the putting result indicia 180 to determine the result of a putt. Being of an enlarged scale, the representation 174 is adapted to receive the appropriate ball marker 38, 40 of a player to thereby indicate location of the player's ball on the green.

In accordance with the invention, the game is generally as previously described wherein said putting result indicia is in the form of numbers in some instances and is in the form of letters in other instances and wherein said putting matrix includes putting result indicia in some instances corresponding to players of championship competence level, and in other instances includes putting result indicia corresponding to players of non-championship competence level.

As embodied herein, with continued reference to FIG. 14, the PUTTING CARD 182 recites putting result indicia 180 which, in some instances, is in the form of numbers which indicate the distance which a player's ball is located from the hole 176 after a toss of the dice 46, 48, and 72. Other possibilities are that the indicia 180 may be in the form of a "M" which indicates a miss, reflecting a situation in which the ball comes to rest within one foot of the hole, or an "IN" which indicates that the ball has landed in the hole. Additionally, FIG. 14 represents one side of the PUTTING CARD 182 which provides hole distance indicia appropriate to golfer's of championship competence level. Of similar format is the other side of the PUTTING CARD 182 (not shown) which provides putting result indicia 180 corresponding to player's of non-championship competence level. It will also be appreciated that when the putting result indicia are in the form of numbers, they are identical to the hole distance indicia 153 and are therefore so indicated in FIG. 13.

The general assumptions utilized in the formation of the putting matrix 184 will now be discussed. In essence, the putting matrix 184 is a development of numbers which provide a general pattern such that the probability of "holing" the ball or obtaining a good result short of a "holed" ball improves as the distance to the hole decreases and, also, as the numbers of the sum of a toss of the dice 46, 48, and 72 approach a mid range, that is, the range of the numbers "8" through "13". By using the dice 46, 48, and 72, the probability of an optimum result is obtained when the mid range of the numbers "8" through "13" is achieved; and moderate, inferior, or superlative results are obtained when the throw of the dice results in numbers lying outside of that mid range of numbers.

In accordance with the invention, the game is generally as previously described wherein at least one of said fairways on said game board includes a plurality of routes extending between said tee and said green; and wherein said first chance means includes route indicia which signify a particular route upon manipulation by a player and, specifically, wherein at least one of said fairways on said game board includes first and second routes, and wherein said first chance means includes a pair of uniformly colored dice, each of said dice having six sides numbered, respectively, one through six, and wherein said sides on at least one of said dice include markings signifying, respectively, travel along said first route and travel along said second route in response to manipulation of said first chance means.

As embodied herein, with reference now to FIG. 11, the fairway 28 is seen to include a central route 194 of distance indicia 35 extending between the tee 24 and the green 26 and a side route 196 of distance indicia 35 which veers off to the right as one proceeds from the tee 24 toward the green 26. As seen in FIG. 5B, the die 48 has two sides provided with markings 198 and 200 in the form of the word "route" on those sides numbered "3" and "2", respectively. These markings 198 and 200 correspond with similar markings on the game boards 20 and 22. Thus, with respect to the fairway 28 illustrated in FIG. 11, if the die 48 were to land in such a manner that the side reading "2 route" landed face up, the side route 196 would then be followed by a player. Similarly, in the event the side marked "3 route" were to land face up, another side route (not shown in FIG. 11) would be followed, so long as the particular fairway or the game boards had corresponding markings. If the die 48 were to show a side without the markings 198, 200, then the central route 194 would be followed by the player. It will be appreciated that the route 194 is preferable to the route 196 in that it is a more direct route between the tee 24 and the green 226 and thus a toss of the die 48 resulting in the display of the markings 198, 200 may be considered to be a form of penalty to a player.

PLAYING THE GAME

Now that the elements of the game havve been fully described, a brief explanation of the play of the game will now be provided. At the outset, any one of the players may toss the die 72 into the scrambler 50 to indicate which HOLE POSITION CARD 152 will be utilized throughout the game. Players then decide upon the level of competence they intend to play and this competence level will be maintained for the player throughout the game. At this point, each player selects an appropriate ball marker 38, 40 and matching fairway marker 52 to be used by him for the entire game. The ball markers 38, 40 are then placed on the first tee and each player tosses the die 72 into the scrambler and the player with the lowest number tees off first.

To play the game, the first player selects a club from the CLUB CARD 58 and tosses all four dice, namely dice 46, 48, 62 and 72 into the scrambler 50. It should be noted that each toss of the dice into the scrambler is considered to be a stroke and the dice are not to be disturbed until the play is completed. After tossing the dice, the player reads the CLUB CARD 58 and moves the ball marker 38, 40 down the fairway 288 the number of yards indicated by the CLUB CARD. If an "R" or a "T" appears on the die 62, reference is made to side one of the TROUBLE POSITION CARD 64 which advises the player of the type of trouble condition which exists at that fairway yard mark as represented by the distance number 110. He then places his ball marker 38, 40 in the rough area or trouble area where the ball landed and places the fairway marker on the fairway 28 at the appropriate location in accordance with the distance indicia 35. The ball marker 38, 40 remains at that location until the player takes his next stroke.

To come out of a rough area or trouble area, side two of the TROUBLE POSITION CARD 64 is utilized before the player makes his next club selection. When the player takes his turn and tosses the dice, the appropriate number indicia 60 as determined from the CLUB CARD 58 are then modified accordingly by the trouble result indicia 68, 69, and 70 on side two of the TROUBLE POSITION CARD 64. The player then removes his ball marker 38, 40 from the rough area or trouble area and, if appropriate, returns it to the fairway 28, removing the fairway marker 42. Each player follows in turn off the tee, and, as in the actual game of golf, thereafter the player who is farthest from the green is the next to take his turn.

When approaching the green, it is important for the player to know in what yard section the hole is located. The player's club selection for landing on the green, as determined from the CLUB CARD 58, must include fairway distance to the green plus the yardage distance to the hole. For example, if the hole 176 is located in the fifteen yard section on the green 26, and the ball lies 155 yards down the fairway, then the player's ball must travel 170 yards to reach the hole.

Putting does not begin until all players have their ball markers 38, 40 placed on the green 26, that is to say, on the enlarged representation 174. To putt, each player tosses three dice, namely the dice 46, 48, and 72 into the scrambler 50, the sum thereby achieved being used to read the PUTTING CARD 182. The player who is farthest from the hole 176 at the outset of putting then takes his turn and continues until he is holed out. Then, the player who is next farthest from the hole takes his turn, and so on, until all player's have completed play to that hole. Score is kept, hole by hole, as in the outdoor game of golf.

In the actual game, there are many other details of the game not described here. Furthermore, while this invention has been described in connection with a particular embodiment, it will be understood that it is capable of modification, and this disclosure is intended to cover any variations, uses, or adaptations following, in general, the principles of the invention and including such departures from the present disclosure as come within known or customary practice in the art to which the invention pertains, and as fall within the scope of the invention, or the limits of the intended claims.

What is claimed is:

1. A parlor game for participation by one or more players closely simulating the outdoor game of golf comprising:

a game board presented as a miniature, in plan view, of a full-scale golf course including appropriate pictorial representations of a tee; a green distant from said tee; a fairway generally extending between said tee and said green; a plurality of troubles positioned on said fairway, adjacent to said fairway, and distant from said fairway; and distance indicia at preselected intervals along said fairway to denote distance from said green; at least one ball marker, representing a player's ball, adapted to be moved manually and positioned on said game board;

first chance means for manipulation by a player for randomly generating numbers having two digits, the first of the digits being equal to or greater than the second of the digits;

a first source of information including separate sets of number indicia thereon relating to each of a plurality of clubs arbitrarily chosen by a player prior to manipulation of said chance means, said number indicia of each of said sets signifying travel of the player's ball when using a particular club according to the numbers generated in response to manipulation of said first chance means;

second chance means for manipulation by a player simultaneously with said first chance means for randomly indicating, from time to time, whether the player's ball following manipulation of said first and second chance means but before the ball lands on said green, is subject to a trouble situation;

a second source of information including trouble condition indicia to which the player's ball may be subjected at preselected intervals corresponding to said distance indicia and corresponding to said pictorial representations on said game board and responsive to an indication by said second chance means that said ball marker of the player is in a trouble condition signifying the extent of the trouble condition to which the player's ball is subjected upon manipulation of said first and second chance means;

third chance means for manipulation by a player for randomly generating numbers having one digit, one of said sets of number indicia of said first source of information relating to a driver club being in the form of a driver matrix, said number indicia of said driver matrix signifying travel of the player's ball according to a combination of the numbers generated in response to simultaneous manipulation of said first chance means and of said third chance means, said driver matrix including a plurality of columns and a plurality of rows, each of said columns having a heading number capable of being generated by manipulation of said third chance means and each of said rows having an identification number capable of being generated in response to manipulation of said first chance means, an intersection of said row and of said column defined, respectively, by said identification numbers and said heading numbers generated in response to manipulation of said first and third chance means resulting in designation of a specific one of said number indicia signifying travel of the player's ball.

2. A game as set forthh in claim 1 wherein said number indicia of said first source of information, selectively according to choice of a player, in one instance are representative of actual players of non-championship competence level, in another instance are representative of men players of championship competence level, and in still another instance are representative of women players of championship competence level such that all players have a substantially equal chance of being competitive within each of said competence levels.

3. A game as set forth in claim 1 wherein said first chance means includes a pair of uniformly colored dice, each said die having six sides numbered, respectively, one through six; and wherein said second chance means includes a die different in color from said first chance means and having six sides, one of said sides marked to represent a rough area condition, one of said sides marked to represent a trouble area condition, and four of said sides being without distinguishing markings; and wherein said third chance means includes a die different in color from said first and second chance means and having six sides numbered, respectively, one through six.

4. A game as set forth in claim 1 wherein said driver matrix includes six columns and 21 rows.

5. A game as set forth in claim 4 wherein said driver matrix includes first, second, and third sections, said first section having nine rows, said second section having six rows, and said third section having six rows, said identification numbers for said first section being, sequentially, those numbers having even first digits of ascending value coupled with second digits of ascending value, said identification numbers for said second section being, sequentially, those numbers having odd first digits of ascending value coupled with second digits of ascending value, and said identification numbers for said third section being, sequentially, those numbers of ascending value having identical first and second digits.

6. A game as set forth in claim 1 wherein said first source of information includes a plurality of groups of number indicia relating to each of a plurality of appropriate ranges of distances arbitrarily chosen by a player prior to manipulation of said chance means, said groups signifying travel of the player's ball when a particular one of said ranges of distances has been chosen, according to the numbers generated in response to manipulation of said first chance means.

7. A game as set forth in claim 1 wherein said troubles include trees, woods, bunkers, lost ball, embedded ball, brush, water hazard, grass of varied lengths, fringe of green, and out of bounds.

8. A game as set forth in claim 1 wherein said second source of information includes a plurality of second trouble matrices signifying the result of an attempt by a player to retrieve his ball from a trouble situation according to the numbers generated in response to a subsequent manipulation of said first chance means and according to the designation of a specific one of said trouble condition indicia to which the player's ball is already subjected.

9. A game as set forth in claim 8 wherein certain parts of said second trouble matrices are in the form of numbers, wherein certain parts of said second trouble matrices are in the form of words, wherein certain parts of said second trouble matrices are alphanumeric in form, and wherein certain parts of said second trouble matrices are symbols other than numbers, words, or of alphanumeric form.

10. A game as set forth in claim 9 wherein said second source of information includes trouble result indicia in the form of a plurality of second trouble matrices having at least one column and 21 rows, each of said second trouble matrices including first, second, and third sections, said first section having nine rows, said second section having six rows, and said third section having six rows, each of said rows having an identification number capable of being generated by said first chance means, said identification numbers for said first section being, sequentially, those numbers having even first digits of ascending value coupled with second digits of ascending value, said identification numbers for said second section being, sequentially, those numbers having odd first digits of ascending value coupled with second digits of ascending value, and said identification numbers for said third section being, sequentially, those numbers of ascending value having identical first and second digits; each of said columns being identified by a specific one of said trouble condition indicia designating a particular trouble situation to which the player's ball is already subjected, an intersection of said row defined by a specific one of said identification numbers generated in response to manipulation of said first chance means and of said column defined by said specific one of said trouble condition indicia resulting in designation of a specific one of said trouble result indicia signifying the outcome to the player's ball.

11. A game as set forth in claim 10 wherein in some instances said trouble result indicia represents the location of the player's ball and in some other instances represents a trouble situation experienced by the player's ball.

12. A game as set forth in claim 1 wherein said green includes a plurality of hole positions, each of said hole positions being identified by a hole position number capable of being generated in response to manipulation of said third chance means at the outset of play of a game.

13. A game as set forth in claim 12 wherein the numbers of said hole positions is six and wherein said third chance means includes a die having six sides numbered, respectively, one through six, each of said sides corresponding, respectively, to a particular one of said hole positions.

14. A game as set forth in claim 12 wherein said green includes a green area and a fringe area at least partially surrounding and proximate to said green area, said fringe area having fringe distance indicia for signifying the location of the player's ball thereon, said green area having hole distance indicia for signifying the location of the player's ball thereon, and including a third source of information corresponding to a particular one of said hole positions including hole distance indicia and fringe distance indicia for signifying the location of the player's ball, in some instances, on said green area and in some other instances on said fringe area occurring in response to manipulation of said first chance means.

15. A game as set forth in claim 1 wherein said green includes a green area and a fringe area at least partially surrounding and proximate to said green area, said green area including hole distance indicia for signifying the location of the player's ball thereon, said fringe area having fringe distance indicia for signifying the location of the player's ball thereon, and including a third source of information having hole distance indicia and fringe distance indicia in the form of a hole position and fringe distance matrix having left and right sets of yard columns, said left set signifying the location of the player's ball on said green in response to manipulation of said third chance means resulting in generation of an odd number, said right set signifying the travel of the player's ball on said green in response to manipulation of said third chance means resulting in generation of an even number.

16. A game as set forth in claim 15 wherein said hole position and fringe distance matrix has a plurality of yard columns and 21 rows, said hole position and fringe distance matrix including first, second, and third sections, said first section having nine rows, said second section having six rows, and said third section having six rows, each of said rows having an identification number capable of being generated in response to manipulation of said first chance means, said identification numbers for said first section being, sequentially, those numbers having even first digits of ascending value coupled with second digits of ascending value, said identification numbers for said second section being, sequentially, those numbers having odd first digits of ascending value coupled with second digits of ascending value, and said identification numbers for said third section being, sequentially, those numbers of ascending value having identical first and second digits, each of said yard columns including a yard heading corresponding to the distance, in yards, between placement of the player's ball in response to the prior manipulation of said first chance means and the location of said hole and including a plurality of rows, an intersection of said row containing said identification number as determined in resonse to manipulation of said first chance means and of said yard column containing said yard heading as determined by the prior manipulation of said first chance means resulting in designation of a specific one of said hole distance indicia and said fringe distance indicia signifying the location of the player's ball on said green.

17. A game as set forth in claim 1 including an enlarged pictorial representation of said green, separate from said game board, having an enlarged scale in relation to said game board and including a designation of a hole thereon and a fringe defining the outer limits of said pictorial representation and hole distance indicia at preselected radial intervals between said hole and said fringe to denote distance, in feet, from said hole.

18. A game as set forth in claim 1 including a fourth source of information including putting result indicia for signifying travel of the player's ball on said green in response to manipulation, in sum of the numbers, of said first and third chance means.

19. A game as set forth in claim 18 wherein said fourth source of information includes a putting matrix having a plurality of putting distance columns, said putting matrix including sequential headings for each of said putting distance columns corresponding to the distance in feet of the player's ball from said hole as determined from said third source of information in response to manipulation of said first and third chance means, said putting matrix including a plurality of rows, each of said rows having an identification number capable of being the sum of the numbers generated in response to manipulation of the said first and third chance means, said plurality of said identification numbers being in sequence, an intersection of said row containing said identification number as determined in response to manipulation of said first and third chance means and of said putting distance column resulting in designation of a specific one of said putting result indicia in response to manipulation of said first and third chance means.

20. A game as set forth in claim 19 including an enlarged pictorial representation of said green, separate from said game board, having an enlarged scale in relation to said game board and including a representation of a hole thereon and a fringe defining the outer limits of said enlarged green, said hole distance indicia being provided on said enlarged green at preselected radial intervals from said hole to said fringe to denote distance, in feet, from said hole, said pictorial representation adapted to receive thereon said ball marker of a player to indicate the location of the player's ball thereon.

21. A game as set forth in claim 19 wherein said putting result indicia are in the form of numbers in some instances and are in the form of letters in other instances.

22. A game as set forth in claim 19 wherein said putting matrix includes putting result indicia corresponding to players of championship competence level.

23. A game as set forth in claim 19 wherein said putting matrix includes putting result indicia corresponding to players of non-championship competence level.

24. A game as set forth in claim 1 wherein at least one of said fairways on said game board includes a plurality of routes extending between said tee and said green; and wherein said first chance means includes route indicia which signify a particular path upon manipulation by a player.

25. A game as set forth in claim 24 wherein at least one of said fairways on said game board includes first and second routes, and wherein said first chance means includes a pair of uniformly colored dice, each of said dice having six sides numbered, respectively, one through six, and wherein said sides on at least one of said dice include markings signifying, respectively, travel along said first route and travel along said second route in response to manipulation of said first chance means.

26. A parlor game for participation by one or more players closely simulating the outdoor game of golf comprising:

a game board presented as a miniature, in plan view, of a full-scale golf course including appropriate pictorial representations of a tee; a green distant from said tee; a fairway generally extending between said tee and said green; a plurality of troubles positioned on said fairway, adjacent to said fairway, and distant from said fairway; and distance indicia at preselected intervals along said fairway to denote distance from said green; at least one ball marker, representing a player's ball, adapted to be moved manually and positioned on said game board;

first chance means for manipulation by a player for randomly generating numbers having two digits, the first of the digits being equal to or greater than the second of the digits;

a first source of information including separate sets of number indicia thereon relating to each of a plurality of clubs arbitrarily chosen by a player prior to manipulation of said chance means, said number indicia of each of said sets signifying travel of the player's ball when using a particular club according to the numbers generated in response to manipulation of said first chance means;

second chance means for manipulation by a player simultaneously with said first chance means for randomly indicating, from time to time, whether the player's ball following manipulation of said first and second chance means but before the ball lands on said green, is subject to a trouble situation;

a second source of information including trouble condition indicia to which the player's ball may be subjected at preselected intervals corresponding to said distance indicia and corresponding to said pictorial representations on said game board and responsive to an indication by said second chance means that said ball marker of the player is in a trouble condition signifying the extent of the trouble condition to which the player's ball is subjected upon manipulation of said first and second chance means;

third chance means for manipulation by a player for randomly generating numbers having one digit, said set of number indicia of said first source of information relating to clubs other than said driver club being in the form of a club matrix for each respective club having left and right columns and wherein odd numbers generated in response to manipulation of said third chance means define said left column and wherein even numbers generated in response to manipulation of said third chance means define said right column, said club matrix including a plurality of rows, each of said rows having an identification number capable of being generated in response to manipulation of said first chance means, an intersection of said row and said column defined, respectively, by said identification numbers and said heading numbers generated in response to manipulation of said first and third chance means resulting in designation of a specific one of said number indicia signifying travel of the player's ball.

27. A game as set forth in claim 26 wherein said first source of information is a club matrix having at least two columns and 21 rows, said club matrix including first, second, and third sections, said first section having nine rows, said second section having six rows, and said third section having six rows, each of said rows having an identification number capable of being generated by said first chance means, said identification numbers for said first section being, sequentially, those numbers having even first digits of ascending value coupled with second digits of ascending value, said identification numbers for said second section being, sequentially, those numbers having odd first digits of ascending value coupled with second digits of ascending value, and said identification numbers for said third section being, sequentially, those numbers of ascending value having identical first and second digits.

28. A parlor game for participation by one or more players closely simulating the outdoor game of golf comprising:

a game board presented as a miniature, in plan view, of a full-scale golf course including appropriate pictorial representations of a tee; a green distant from said tee; a fairway generally extending between said tee and said green; a plurality of troubles positioned on said fairway, adjacent to said fairway, and distant from said fairway; and distance indicia at preselected intervals along said fairway to denote distance from said green; at least one ball marker, representing a player's ball, adapted to be moved manually and positioned on said game board;

first chance means for manipulation by a player for randomly generating numbers having two digits, the first of the digits being equal to or greater than the second of the digits;

a first source of information including separate sets of number indicia thereon relating to each of a plurality of clubs arbitrarily chosen by a player prior to manipulation of said chance means, said number indicia of each of said sets signifying travel of the player's ball when using a particular club according to the numbers generated in response to manipulation of said first chance means;

second chance means for manipulation by a player simultaneously with said first chance means for randomly indicating, from time to time, whether the player's ball following manipulation of said first and second chance means but before the ball lands on said green, is subject to a trouble situation;

a second source of information including trouble condition indicia to which the player's ball may be subjected at preselected intervals corresponding to said distance indicia and corresponding to said pictorial representations on said game board and responsive to an indication by said second chance means that said ball marker of the player is in a trouble condition signifying the extent of the trouble condition to which the player's ball is subjected upon manipulation of said first and second chance means;

third chance means for manipulation by a player for randomly generating numbers having one digit, said trouble condition indicia of said second source of information being in the form of a first trouble matrix having left and right sets of columns, said left set signifying the extent of said trouble to the player's ball upon manipulation of said third chance means resulting in generation of an odd number, said right set signifying the extent of said trouble to the player's ball upon manipulation of said third chance means resulting in generation of an even number and including a plurality of rows, each of said rows having distance numbers corresponding sequentially to said distance indicia, an intersection of said row containing a specific one of said distance numbers as determined from said number indicia of said first source of information in response to manipulation of said first chance means and of said column defined by the result of manipulation of said second and third chance means resulting in designation of a specific one of said trouble condition indicia to which the player's ball is subjected.

29. A game as set forth in claim 28 wherein said left and right sets each include a column designating said trouble condition indicia, respectively, as situations existing on said fairway, as situations existing in a rough area adjacent to said fairway, and as situations existing in a trouble area adjacent to said rough area and distant from said fairway, all according to the indication resulting in response to manipulation of said second chance means.

30. A parlor game for participation by one or more players closely simulating the outdoor game of golf comprising:

a game board presented as a miniature, in plan view, of a full-scale golf course including appropriate pictorial representations of a tee; a green distant from said tee; a fairway generally extending between said tee and said green; a plurality of troubles positioned on said fairway, adjacent to said fairway, and distant from said fairway; and distance indicia at preselected intervals along said fairway to denote distance from said green;

at least one ball marker, representing a player's ball, adapted to be moved manually and positioned on said game board;

first chance means for manipulation by a player for randomly generating numbers having two digits, the first of the digits being equal to or greater than the second of the digits;

a first source of information including separate sets of number indicia thereon resulting to each of a plurality of clubs arbitrarily chosen by a player prior to manipulation of said chance means, said number indicia of each of said sets signifying travel of the player's ball when using a particular club according to the numbers generated in response to manipulation of said first chance means, said first source of information being in the form of a matrix for each respective club, each said matrix having at least one column and 21 rows, each said matrix including first, second, and third sections, said first section having nine rows, said second section having six rows, and said third section having six rows, each of said rows having an identification number capable of being generated in response to manipulation of said first chance means, said identification numbers for said first section being, sequentially, those numbers having even first digits of ascending value coupled with second digits of ascending value, said identification numbers for said second section being, sequentially, those numbers having odd first digits of ascending value coupled with second digits of ascending value, and said identification numbers for said third section being, sequentially, those numbers of ascending value having identical first and second digits, an intersection of said row and said column defined, respectively, by said identification number generated in response to manipulation of said first chance means resulting in designation of a specific one of said number indicia signifying travel of the player's ball and wherein, statistically, the player has an optimum chance of obtaining one of said number indicia lying within said first section upon manipulation of said first chance means and wherein said number indicia said first section are preselected to be representative of average distances of travel of the player's ball, and wherein, statistically, the player has only a moderate chance of obtaining one of said number indicia lying within said second section upon manipulation of said first chance means and wherein said number indicia within said second section are preselected to be representative of distances falling below the normal range for a particular club, and wherein, statistically, the player has the least chance of obtaining one of said number indicia lying within said third section upon manipulation of said first chance means and wherein said number indicia within said third section are preselected to be representative of distances either above the range or extremely below the range normal for a particular club;

second chance means for manipulation by a player simultaneously with said first chance means for randomly indicating, from time to time, whether the player's ball following manipulation of said first and second chance means but before the ball lands on said green, is subject to a trouble situation; and a second source of information including trouble condition indicia to which the player's ball may be subjected at preselected intervals corresponding to said distance indicia and corresponding to said pictorial representations on said game board and responsive to an indication by said second chance means that said ball marker of the player is in a trouble condition signifying the extent of the trouble condition to which the player's ball is subjected upon manipulation of said first and second chance means.

* * * * *